United States Patent [19]

Gerber

[11] Patent Number: 4,476,992

[45] Date of Patent: Oct. 16, 1984

[54] RESERVOIR COVER WITH TENSIONED PLATES

[75] Inventor: Dennis H. Gerber, Los Gatos, Calif.

[73] Assignee: Burke Industries, Inc., San Jose, Calif.

[21] Appl. No.: 425,556

[22] Filed: Sep. 28, 1982

Related U.S. Application Data

[63] Continuation-in-part of Ser. No. 332,972, Dec. 21, 1981, abandoned.

[51] Int. Cl.[3] ..... B65D 88/38

[52] U.S. Cl. ..... 220/219; 220/216

[58] Field of Search ..... 220/216–227; 210/DIG. 9; 4/498–503

[56] References Cited

U.S. PATENT DOCUMENTS

| | | | |
|---|---|---|---|
| Re. 30,146 | 11/1979 | Dial et al. | 4/499 X |
| 3,517,513 | 6/1970 | Renshaw et al. | 220/218 |
| 3,815,367 | 6/1974 | Collins et al. | 220/216 X |
| 3,874,175 | 4/1975 | Winters | 220/216 X |
| 3,991,900 | 11/1976 | Burke et al. | 220/219 |
| 4,139,117 | 2/1979 | Dial | 220/218 |

*Primary Examiner*—Charles E. Phillips
*Assistant Examiner*—Robert Petrik
*Attorney, Agent, or Firm*—James R. Cypher

[57] ABSTRACT

A flexible cover for an open reservoir covering the entire reservoir characterized by tensioned plates formed over substantially the entire surface area, a central sump and interconnecting pre-programmed positioned sumps. Lines of segmented weights are positioned with respect to the cover and form the sumps. The reservoirs may take a number of configurations; all of which can use the cover of the present invention where the weight placement parameters are met.

12 Claims, 76 Drawing Figures

RESERVOIR COVER WITH TENSIONED PLATES

BACKGROUND OF THE INVENTION

This invention is a continuation-in-part of my application entitled TENSIONED PLATE RESERVOIR COVER, Ser. No. 06/332,972 filed Dec. 21, 1981 now abandoned.

This invention relates to flexible, weather resistant covers for large reservoirs. Flexible covers are replacing the standard hardshell reservoir roofs because of the greatly reduced installation and maintenance costs. Flexible covers must be designed to collect and dispose of rain water, and in cold climates; ice. Further, provision must be made for access to all parts of the cover so that debris may be removed, the cover inspected and repaired if accidentally punctured.

Early covers such as Dial, U.S. Pat. No. 3,313,443, now U.S. Pat. No. Re. 30,146 which is in wide usage, are designed to be carried by floats placed either above or below the flexible cover. Unless anchored to the reservoir bottom, the entire Dial cover can be shifted by the wind thereby changing the location of the peripheral sumps. Surface water drainage is sometimes a problem since the floats do not uniformly support the cover, random puddles develop, and the surface water does not drain to the peripheral sumps. Access to the cover is sometimes difficult since the peripheral sump can be very wide and is not easily crossed. There is danger in crossing the sump area even when there is no water in the sump since there are no floats in the sump area and the weight of a workman will depress the cover; attracting puddled surface water to the site of the workman. The danger is that the workman cannot move out of the depression. Special precautions must be taken to avoid this problem.

Burke, U.S. Pat. No. 3,991,900 discloses a flexible cover which does not require floats. Burke teaches a construction for specifically locating the rainwater drainage canals or sumps, but does not teach a cover construction for placing all portions of the cover in tension so that workmen will have safe access to all parts of the cover for maintenance and repair.

Collins, U.S. Pat. No. 3,815,367; often referred to as the "Columbia" system discloses a system for tensioning the entire cover, but no provision is made for locating sumps in any definite locations. Surface water is simply pumped from the lowest point on the surface; wherever that may occur.

SUMMARY OF THE INVENTION

The present invention is a weather resistant, flexible, reservoir cover designed to be supported by the fluid it covers with weights strategically attached to form surface water sumps which form in pre-programmed locations for all working fluid levels and which also cause programmed tension horizontal cover portions sometimes referred to as in a plurality of defined tensioned plates substantially covering the entire reservoir surface.

The surface water sumps are interconnected so that strategically located sump pumps can quickly and easily pump surface water from the reservoir.

The weighted elements cause the tensioned plates to have a preselected tension so that workmen can traverse all portions of the cover at all working fluid levels for purposes of inspection, maintenance and repair.

The weighted elements cause the rainwater sumps to form at pre-selected locations for the placement of sump pumps, de-icing equipment and other maintenance apparatus.

The cover of the present invention requires no float members or other apparatus to cause the cover to remain in place.

The programmed weight elements forming the tensioned plates and program located rainwater sumps prevent wind drifting of the cover over the reservoir surface.

The use of the present design without floats attached adjacent the sumps provides a unique type of sump which spreads at the surface as the sump fills with the rainwater. Where it is desirable to minimize pumping costs and permit the rainwater to evaporate such as in brine storage ponds, the present invention provides a unique design solution.

Figure 1:
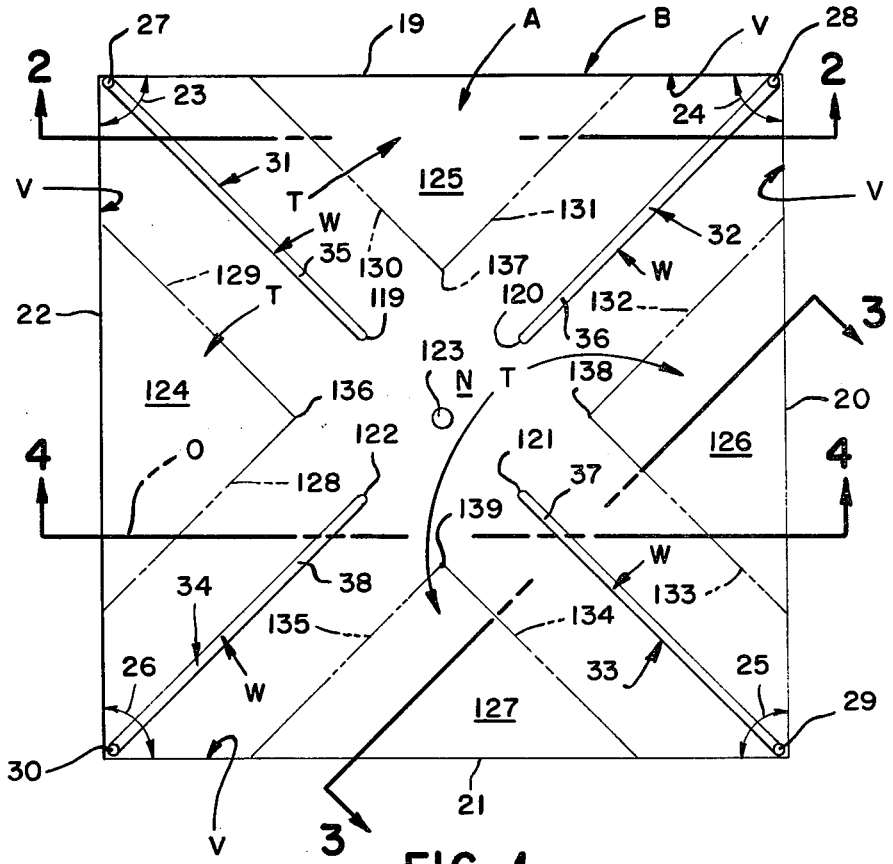
FIG. 1 is a plan view of the cover of the present invention positioned in an empty reservoir.

The phantom lines in the drawings define the edges of the cover material used in forming the sumps. The phantom lines also indicate the edges of the tensioned plates.

DESCRIPTION OF THE PREFERRED EMBODIMENTS OF THE INVENTION

The cover A of the present invention with slight modifications may be used in several types of open reservoirs. Three general categories of reservoirs are specifically described in this application: namely, (1) Reservoirs B of various shapes and all sidewalls V being generally vertical, (2) Reservoirs C having all sidewalls S sloped, and (3) Reservoirs M having both sloped and vertical sidewalls.

1. Vertical Side Reservoirs:

Reservoirs with vertical side walls are shown in FIGS. 1-10, and FIGS. 48-62.

Referring to FIGS. 1-4, the tensioned plate reservoir cover A for placement upon the water surface L of an open reservoir B having substantially vertical sides V consists briefly of a flexible cover member A of fuid impervious material of sufficient area to cover the sidewalls V and bottom E of the reservoir when empty. Means are provided for connecting the perimeter of the cover member to the perimeter of the reservoir. Standard connections may be used and are commerically available. The weighting means W are positioned with respect to the cover member either by gravity or mechanical connection at pre-selected positions forming a plurality of defined, narrow, and generally vertical inter-connected surface water sumps P below the reservoir water surface which are pre-programmed located over the entire range of working fluid level conditions. The weighting means create in the cover member a plurality of tensioned plates T of pre-selected tension for the entire range of working fluid level conditions which cover substantially the entire area of the reservoir. The weighting may be segmented and substantially interconnected or substantial gaps may occur therebetween.

In order to tension the plates and form sumps at pre-programmed locations at all working reservoir levels, the weighting means are located on the cover so that at least two defined sumps cross or are coincident with substantially all section lines 0 extending across non-adjacent side of the reservoir. This configuration of sumps results in all horizontal cover portions being in tension in two horizontal directions.

3. Vertical and slope sided reservoirs:

Reservoirs with vertical and sloped sides are illustrated in FIGS. 36-42. Referring to FIGS. 36-39, the tensioned plate reservoir cover A for placement upon the water surface L of an open reservoir having sloped side walls S and a vertical wall V consists briefly of a flexible cover member A of fluid impervious material of sufficient area to cover the sidewalls and bottom of the reservoir when empty. Means are provided for connecting the perimeter of the cover member to the perimeter of the reservoir. The weighting means W are connected to the cover member at pre-selected positions forming a plurality of defined, narrow and generally vertical interconnected elongated surface water sumps P below the reservoir water surface over the entire range of working fluid level conditions. The weighting means create in the cover member a plurality of plates T of pre-selected tension for the entire range of working fluid level conditions and which cover substantially the entire area of the reservoir.

In order to tension the plates and form sumps at pre-programmed locations at all working reservoir levels, the weighting means create at least two defined sumps P crossing or coincident with substantially all section lines 0 extending across a vertical side wall and a non-adjacent side of the reservoir and the weighting means creating at least one defined sump P crossing or coincident with substantially all section lines 0 extending across non-adjacent sloped sides of the reservoir. This relationship results in all of the horizontal cover portions being in tension in two horizontal directions.

Figure 43:
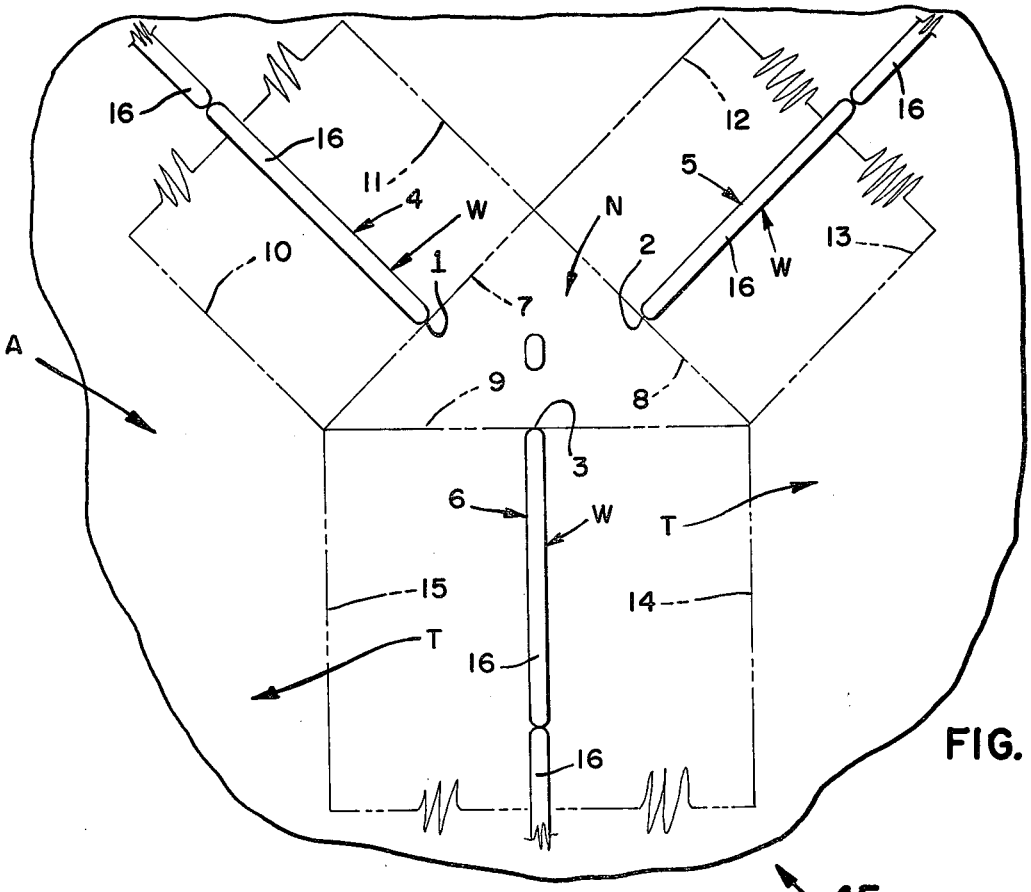
FIG. 43 is an enlarged plan view of a typical sump intersection with the cover positioned in an empty reservoir such as the one shown in FIG. 11 taken generally along line 43—43.

It is essential in the construction of all reservoir covers that all of the sumps interconnect so that excess rain water may be pumped from the reservoir with a minimum of equipment. The construction of the reservoir cover and specifically the attachment locations of the segmented lines of weights is therefore an important part of the invention. A detail of the intersection of three (3) sumps is illustrated in FIG. 43. The detail shown applies to all of the examples illustrated where there is an intersection of three (3) or more sumps. See for example, FIG. 11.

In FIG. 43, the detail shows the reservoir in the empty condition. Note the separation of the ends 1-3 of the segmented lines of weights 4-6. The triangular area free of weights is referred to as the non-interference area N. The area is bounded by lines 7-9. It is important that none of the weights protrude into the non-interference area so that when the reservoir is filled, the ends of the weights do not touch so as to place the interconnected weights in compression. It is important that no compression be placed by one weight upon another so that there will be substantially no stress transmitted to the cover.

A spot weight H is placed in the centroid of the non-interference area for the purpose of forcing the non-interference area of the cover downwardly to take the folds out of this area which might occur and to draw the cover downwardly. In some instances, air could become entrapped beneath the non-interference area of the cover and buoy it to the surface thereby preventing interconnection of the sumps at all water levels. As the reservoir fills, each of the lines of segmented weights may move towards the centroid but the ends of the weights are spaced so that they approach but do not touch when the reservoir is filled. As the reservoir fills the weight remains at the lowest point in the sump but above the bottom of the reservoir and the cover portions on either side of the weights are drawn together. Thus, as shown in FIG. 43 the portion of the cover indicated by phantom lines 10 and 11 would move toward one another just as the portion of the cover indicated by lines 12 and 13 would also approach one another as the reservoir fills. In like manner, the portion of the cover indicated by phantom lines 14 and 15 would also approach one another.

Figure 44:
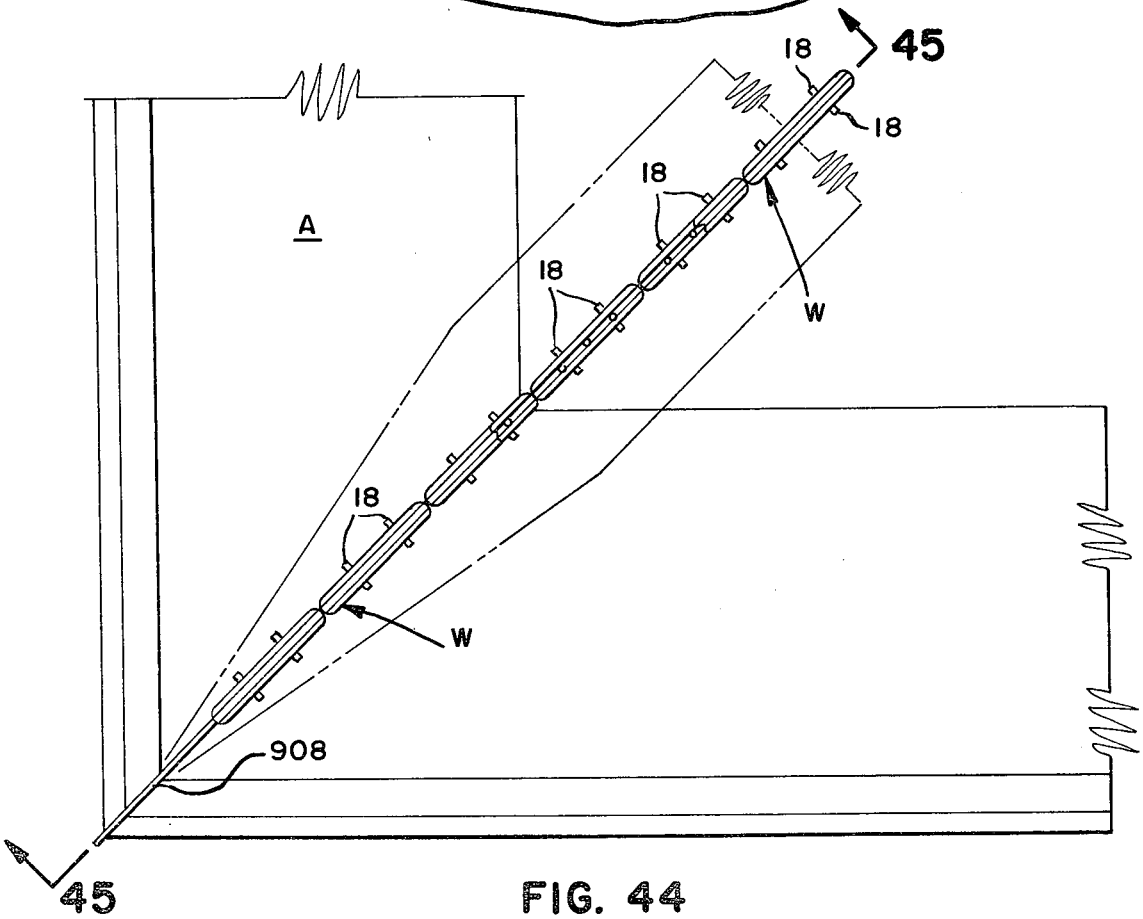
FIG. 44 is an enlarged plan view of a portion of the reservoir shown in FIG. 16 taken generally along line 44—44.

As set forth above, it is essential that the weight means be formed and attached to the cover so that they do not roll around or get out of alignment. The positioning is important so that localized stress is not placed upon the cover which would tear or stretch it. One means for forming the segmented weights is to form elongated tubes 16 as shown in FIGS. 43–47 which are made of the same or similar material as the cover itself. These tubular members can then be filled with sand 17 or other grandular material which has a higher specific gravity than water and will yield to localized forces. These tubes can be attached to the cover by various means such as 3 inch wide strap members 18 placed at convenient intervals along the tube as shown in FIG. 44. It would also be possible to make the elongated segmented weights in other ways such as bonding the sand filled tubes directly to the cover by forming the tubes with flaps.

Since the elongated weights must bend as the reservoir is filled and the cover lifts from the bottom, it is desirable to contruct the sand filled tubes in convenient lengths of 4 to 8 feet in length so that articulation occurs in the lines of weights as the bend angles change. For example, it is good design practice to insure that the length of each segment is shorter in the vicinity of the intersections between the sloped sides and the bottom of the reservoir. Thus, a particular line of weights when placed in an empty reservoir will assume the slope of the sidewall and an angle will be formed at the point where the slope wall and the generally horizontal bottom intersect. As the water level rises, the angle will change until the entire line of weights is horizontal.

Preferably the weights are positioned in all of the reservoirs so that sumps are formed to intersect each angle formed by the intersection of non-horizontal sides. For example, in FIG. 1, vertical sidewalls 19–22 intersect, forming angles 23–26. Lines of vertically hanging segmented weights 27–30 are attached to the cover at the interesections of the vertical sidewalls and lines of segmented weights 31–34 on the bottom form sumps 35–38 as the water rises in the reservoir.

Figure 11:
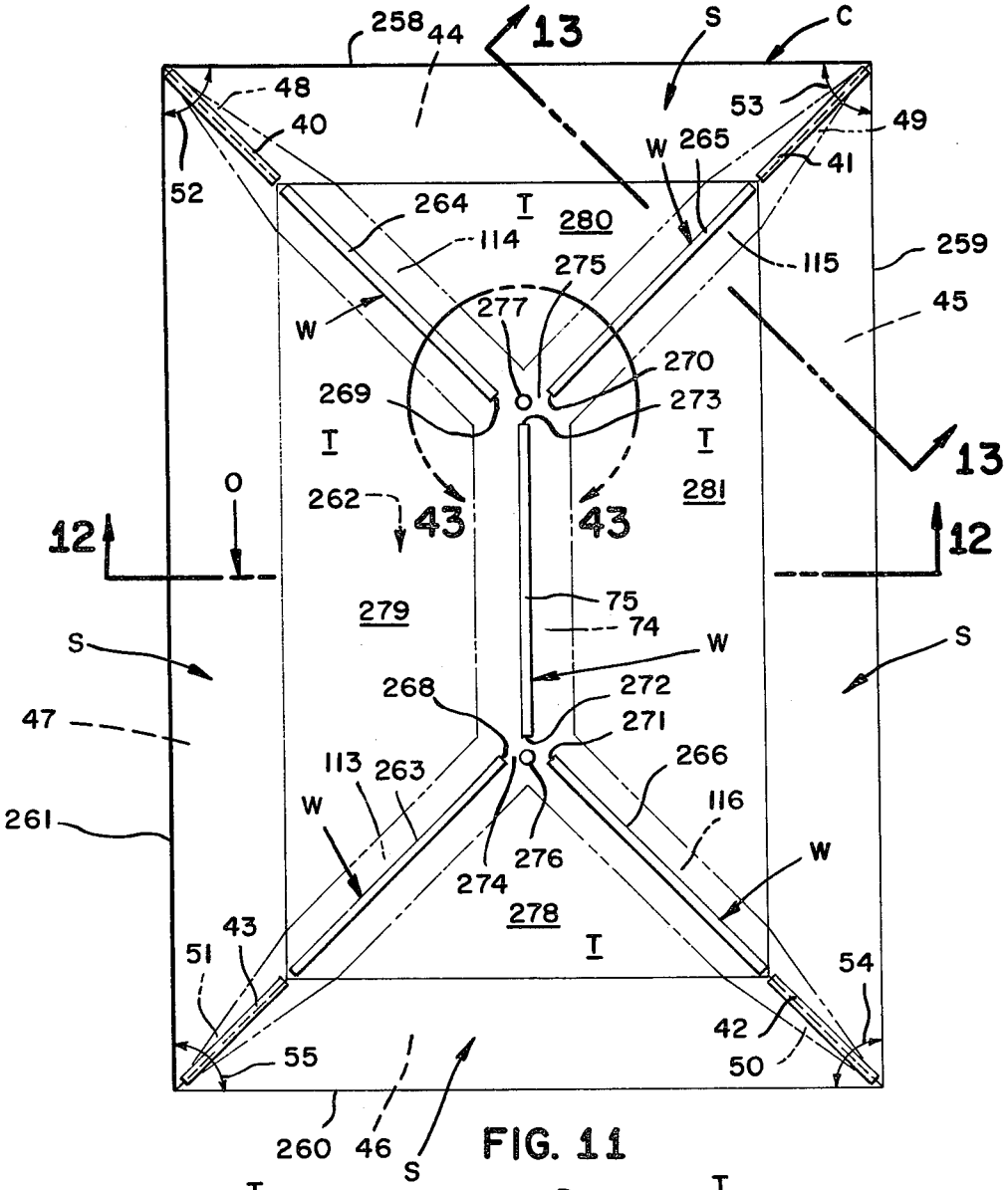
FIG. 11 is a plan view of a rectangular reservoir with sloping sidewalls showing the cover positioned in an empty reservoir.

An example of a sloping sidewall reservoir which demonstrates the intersection of sumps with the intersection of non-horizontal walls is shown in FIG. 11. Lines of segmented weights 40–43 are attached to the cover at each of the intersections of the sloping walls 44–47 so that sumps 48–51 intersect angles 52–55 formed by the intersection of the non-horizontal sides.

An example of a reservoir which is formed with vertical and sloped sidewalls is set forth in FIGS. 36–39 having a vertical wall 921 and slopping walls 57–60. Weights 61–63 are attached so that sumps 64–66 are formed to intersect the angles 67–69 formed by the intersection of sloping sides 57–60. Segmented weights 70 and 71 intersect the angle 72 and 73 formed by the intersection of the vertical wall 921 and sloped walls 57 and 60. Thus, when the reservoir is empty the weights 70 and 71 will be parallel to the vertical wall but at any filling of the reservoir, the weights will intersect angle 72 and 73 and continue to intersect the angle 72 and 73 until the weights reach the positions shown in dotted lines 70' and 71'.

The weighting means in each form of the invention is positioned on the reservoir cover to form a central sump. In FIG. 11, the central sump 74 is a single elongated line formed above segmented weights 75. Diagonal sumps 113–116 connect the corner sumps 48–51 to the central sump. The location of the sump as described insures that all horizontal cover portions are in tension in two horizontal directions.

Figure 14:
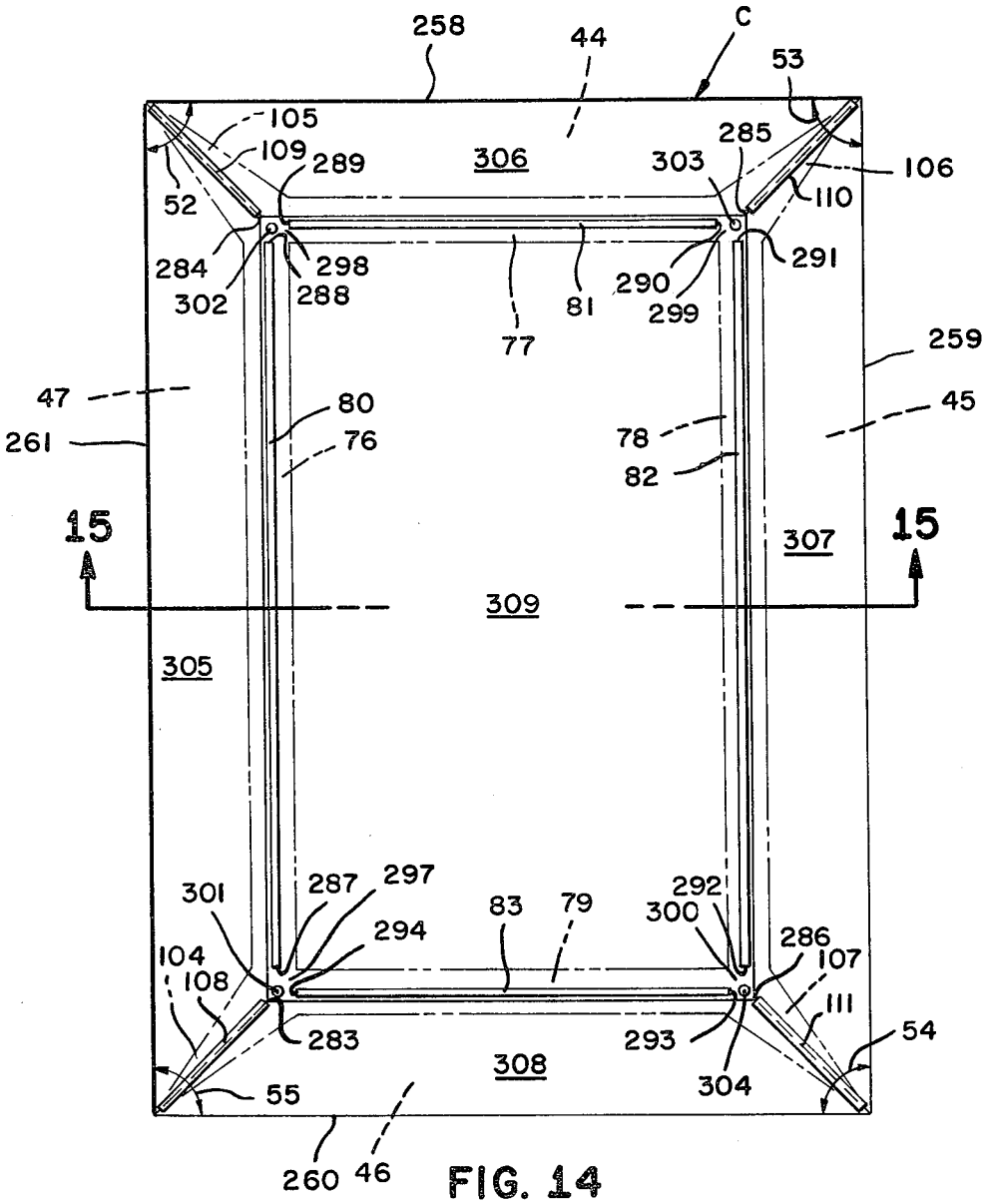
FIG. 14 is a plan view of a rectangular reservoir having the same shape as the reservoir shown in FIG. 11. A modified cover is positioned in an empty reservoir.

The central sump may also take the form of the shape of the reservoir as shown in FIG. 14 in which the central sump consists of the four (4) sumps 76–79 located above weights 80–83. Corner sumps, 104–107 formed by lines of segmented weights 108–111 connect the corners of the rectangular reservoir to the central sump.

Figure 22:
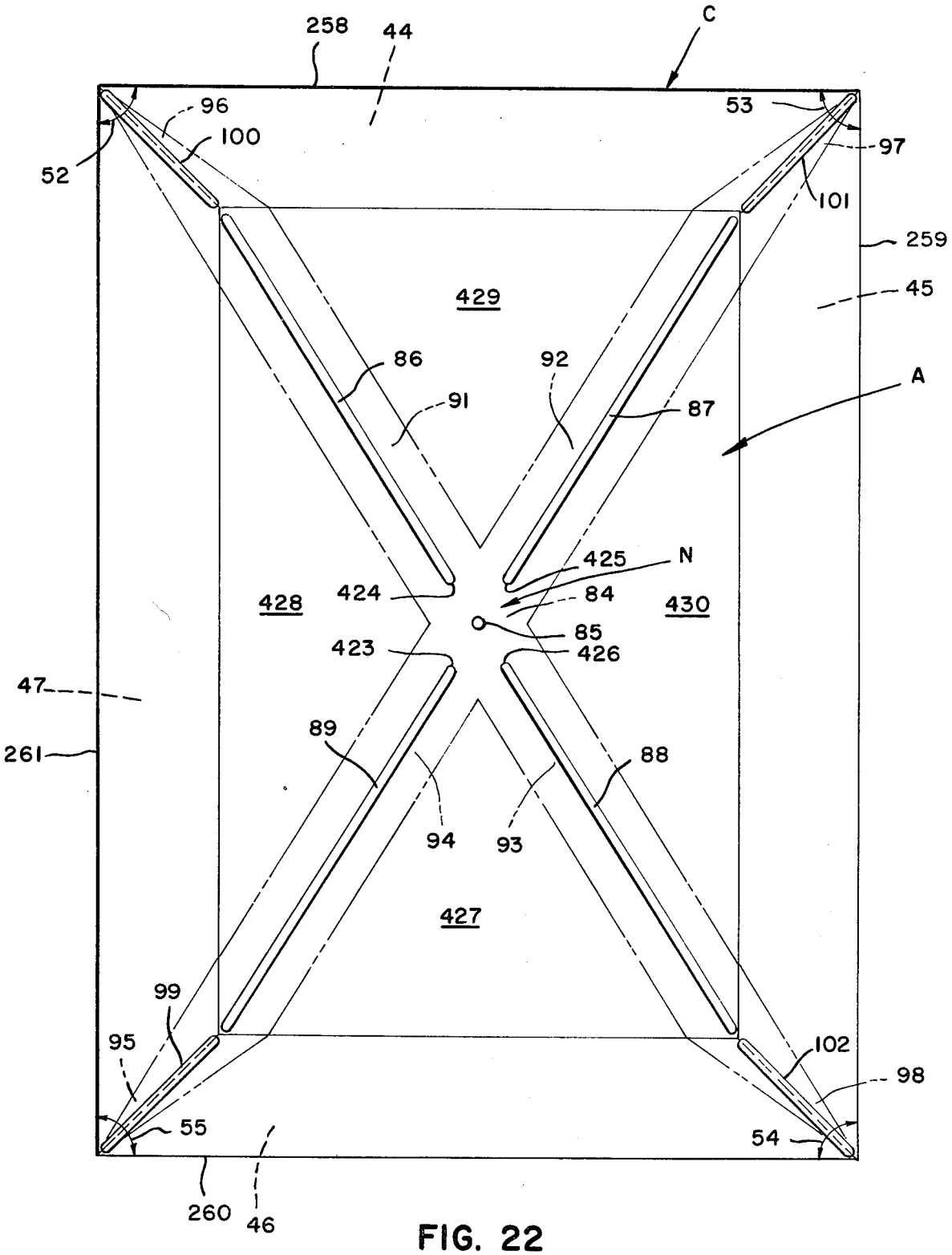
FIG. 22 is a rectangular reservoir having the same shape as the reservoir shown in FIGS. 14, 16, and 19. A modified form of the cover is shown positioned in an empty reservoir.

Still another form of central sump is shown in FIG. 22 in which the central sump 84 is formed in the non-interference area N of the cover A located above spot weight 85. The weighting means in FIG. 22 is positioned on the cover to form a plurality of lines of segmented weights 86–89 which form sumps 91–94. These sumps connect with the corner sumps 95–98 formed above weights 99–102. The weights have ends 423–426 which terminate at the edge of the non-interference area.

Figure 2:
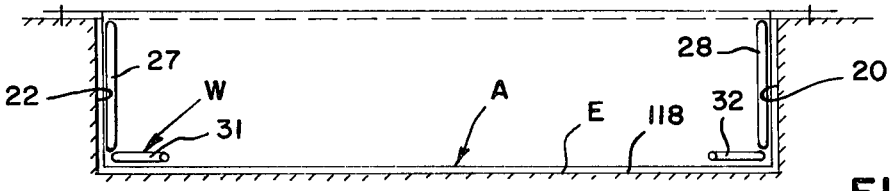
FIG. 2 is a cross section of the reservoir shown in FIG. 1 taken along line 2—2 showing the position of the cover when the reservoir is empty.
Figure 3:
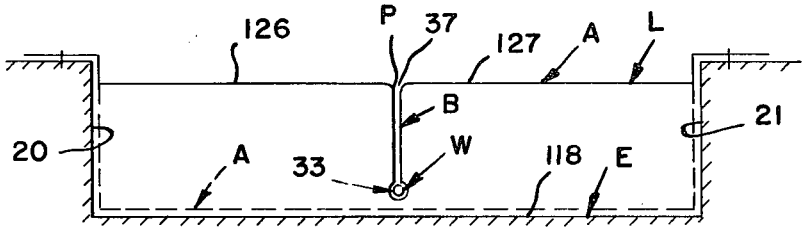
FIG. 3 is a cross section of the reservoir shown in FIG. 1 taken alone line 3—3 showing the position of the cover when the reservoir is filled.

In Example #1 as shown in FIGS. 1–4, the reservoir has four vertical side walls 19–22, and a horizontal bottom surface 118. Segmented weight member 27–30 are attached to the cover A so that they extend from the upper water level L down the corners of the reservoir to the bottom surface and thence diagonally across the bottom of the reservoir to a point short of the middle. The location of the ends 119–122 of each of the diagonal weights are positioned outside the non-interference area N. The location of the weights in FIGS. 1 and 2 are illustrated when the reservoir is empty. As the water level rises to the maximum height, the weights rise with the cover and assume the positions shown in FIGS. 3 and 4. The weight ends 119–122 move radially inwardly to the center of the reservoir and stop just short of spot weight 123. The ends of diagonal weights 31–34 do not touch under any working level condition so that undue stress is not placed upon the cover at the point of attachment of the weights.

Figure 4:
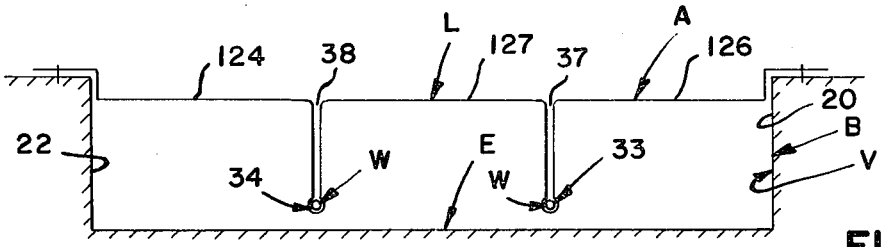
FIG. 4 is a cross section of the reservoir shown in FIG. 1 taken along line 4—4 showing the position of the cover when the reservoir is full.

As shown in FIG. 4, two sumps 37 and 38 cross or are coincident with section line 4–4 extending across non-adjacent sides 20 and 22 of the reservoir.

Under all operative water levels, rainwater sumps 35–38 are formed vertically above each line of weights attached to the cover and above the spot weight 123. Thus, all the sumps are interconnected. Four tensioned plates 124–127 are formed at all water levels. The dimensions of the plates are not static, but change as the reservoir is filled. As shown in FIG. 1 the reservoir is shown in the empty condition and the tensioned plates are bounded by edges 128–135 as shown in phantom lines. As the reservoir fills, each point on the plate edge moves at right angles to the reservoir side 19–22 to which the plate is attached. Thus, points 136–139 move to a location adjacent to a point directly above spot weight 123. As the reservoir fills, weights 27–30 move at a diagonal so that at all working levels the reservoir rainwater sumps extend diagonally across the reservoir to each corner. The sumps are all interconnected so that a single pump placed in any sump could drain all of the sumps. As may be seen in FIG. 1, all portions of the cover not designated as plates form the vertical sumps as the water rises.

The central sump is formed in the non-interference area N above spot weight 123.

Figure 5:
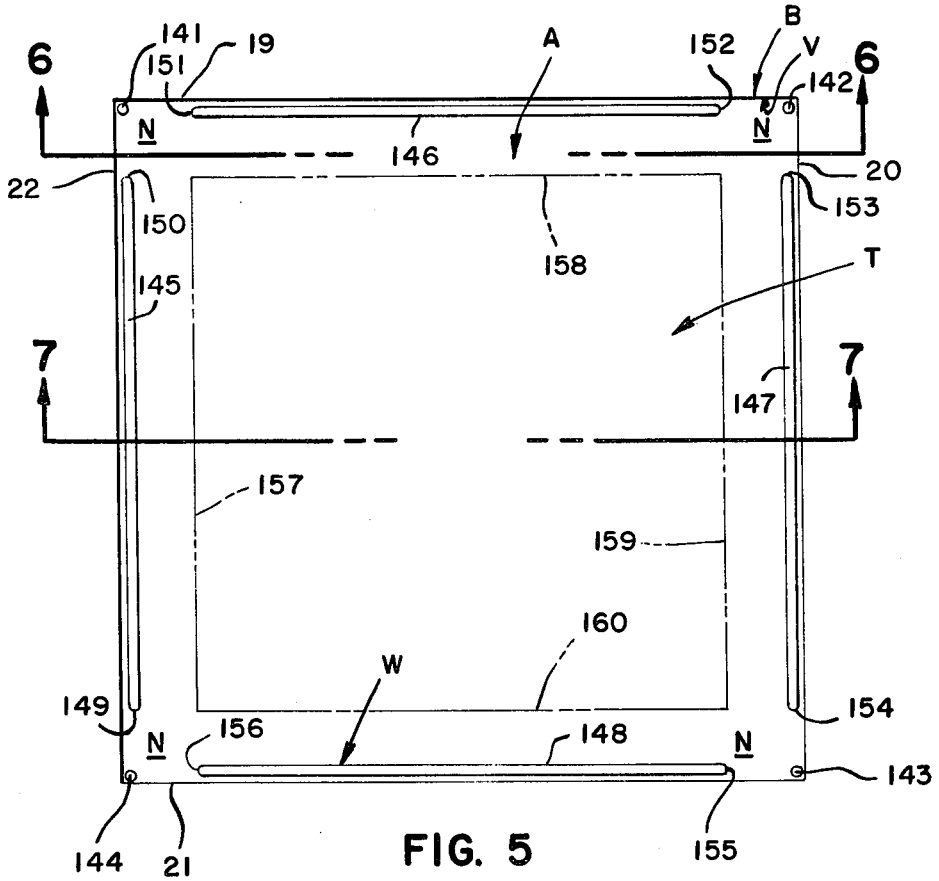
FIG. 5 is a plan view of a reservoir illustrating another form of the invention with the cover positioned in an empty reservoir.
Figure 6:
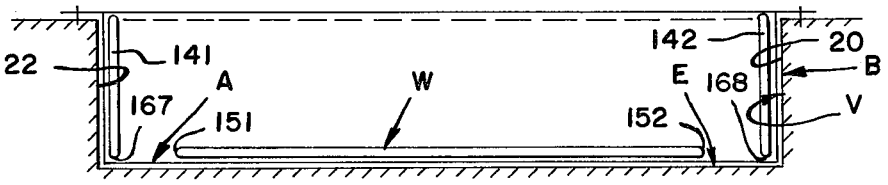
FIG. 6 is a cross sectional view of the reservoir shown in FIG. 5 taken along line 5—5 showing the position of the cover in an empty reservoir.
Figure 7:
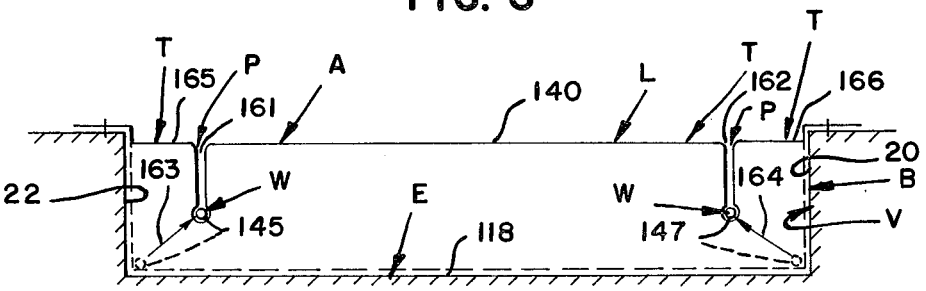
FIG. 7 is a cross sectional view taken along line 7—7 of FIG. 5 showing the position of the cover when the reservoir is full.
Figure 8:
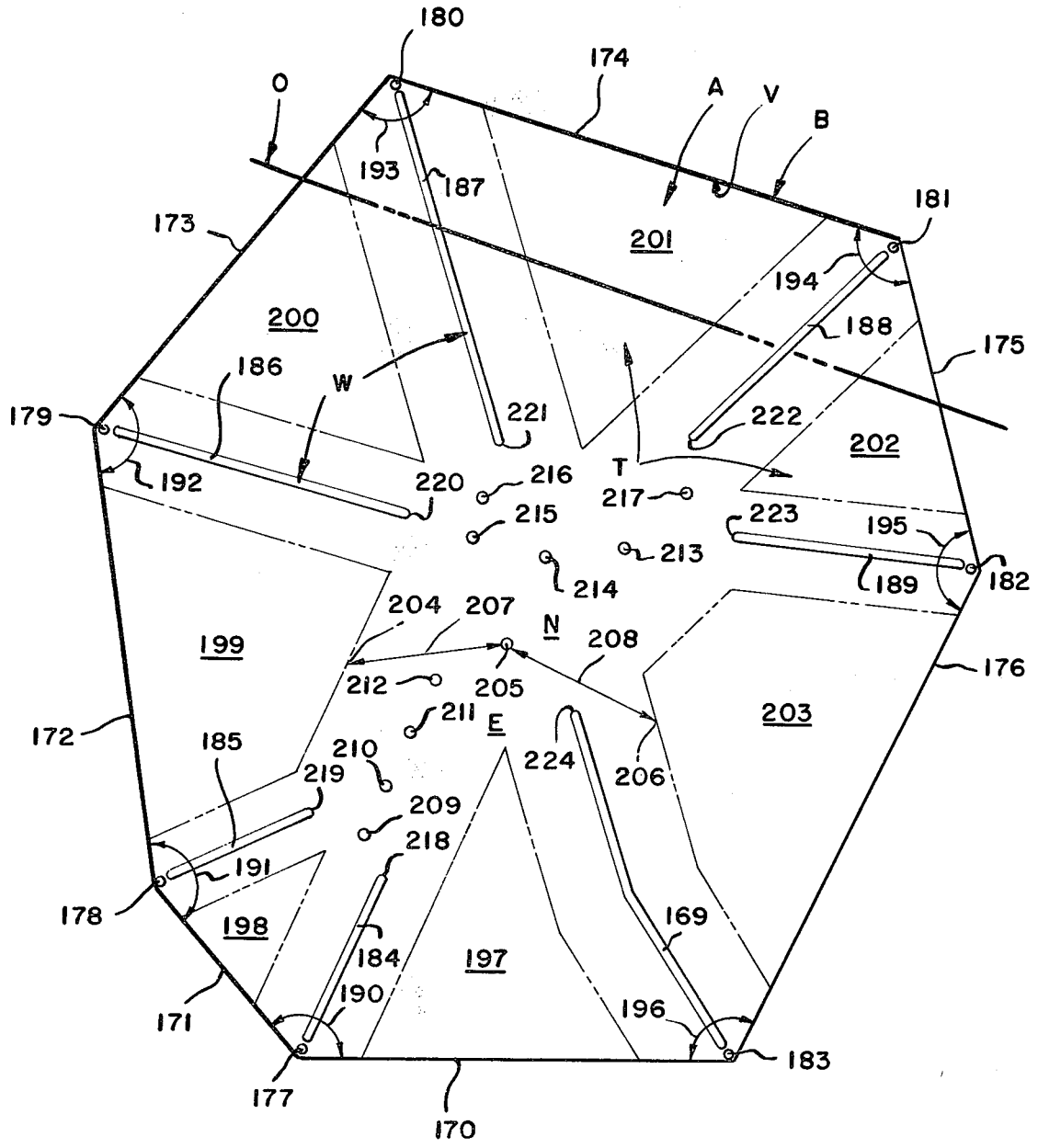
FIG. 8 is a plan view of a polygonal unequal sided reservoir showing the position of the cover of the present invention in an empty reservoir.

In Example #2 illustrated in FIGS. 5, 6 and 7, the reservoir is identical to the reservoir shown in FIG. 8 having four vertical sides and a horizontal bottom surface 118. FIGS. 5 and 6 show the position of the weights when the reservoir is empty. Four lines of segmented weights 141–144 are attached to the cover at the intersection of each non-horizontal wall of the reservoir and extend from the full level L to the bottom surface E. Four segmented weights 145–148 are connected to the cover adjacent each side wall with their ends 149–156 terminating before reaching the non-interference areas N. FIG. 6 is a cross section of the reservoir showing the position of the weights when the reservoir is empty. FIG. 7 shows the position of the weights when the reservoir is full. Rainwater sumps are formed directly above each line of weights. As the reservoir fills, the weights and sumps move inwardly until they reach a position approximately at phantom lines 157–160 shown in FIG. 5.

In this example, there is primarily one large tensioned plate 140 which is bounded by a central sump formed above weights 145–148. As the reservoir fills, tensioned plates are formed around the perimeter of the reservoir and extend toward the center as the reservoir fills. Tensioned perimeter plates 165 and 166 are illustrated in FIG. 7. When the reservoir is filled, weight ends 149–156 approach each other but are not in touching contact with the bottom end of the corner weights such as ends 167 and 168 so none of the weights are in compression.

Either section lines 6—6 or 7—7 extending from non-adjacaent walls across the reservoir intersects two sumps 161 and 162. Arrows 163 and 164 represent the path of weights 145 and 147 as the water level rises in the reservoir. It is to be observed that the segmented weights place the cover in tension for all working fluid levels.

In example #3 illustrated in FIG. 8 the reservoir has seven vertical sides 170–176. All of the sides are unequal in length but similar design considerations apply if one more more are equal in length. At each of the corners, segmented weights 177–183 are attached to the cover A along the intersection of the non-horizontal walls and extend from substantially the highest reservoir level to the bottom E of the reservoir. Segmented weights 184–189 and 169 are attached to the cover A and extend from the previously designated initially vertically extending weights in a direction which bisects angles 190–196 formed at the intersection of the adjacent sidewalls forming the previously designated corners. These segmented weights extend toward the central portion of the reservoir and terminate at end points 218–224 on the edge of the non-interference area N. None of the weight ends touch at any working reservoir fluid level.

The phantom lines in FIG. 8 designate the boundries of the tensioned plates 197–203 when the reservoir is empty and also serve to designate the boundry of the cover used in forming the rainwater sumps. As the reservoir is filled, each point on the boundry of the tensioned plates moves normal to the side of the reservoir to which it is attached. Thus, for example, point 204 on plate 199 moves in the direction of spot weight 205 and point 206 on plate 203 moves in the direction of spot weight 205. Spot weight 205 is located so that the distances from points 204 and 206 to the spot weight as indicated by arrows 207 and 208 are equal. Spot weights 209–217 are located in like manner so that none of the ends 218–224, of the lines of segmented weights touch or are placed in compression.

Spot weights 205 and 209–217 are attached to the cover to insure that at all working levels, there will be interconnection between all of the sumps and the formation of a central sump.

Section line 0 is crossed by two sumps formed above lines of segmented weights 187 and 188.

Figure 9:
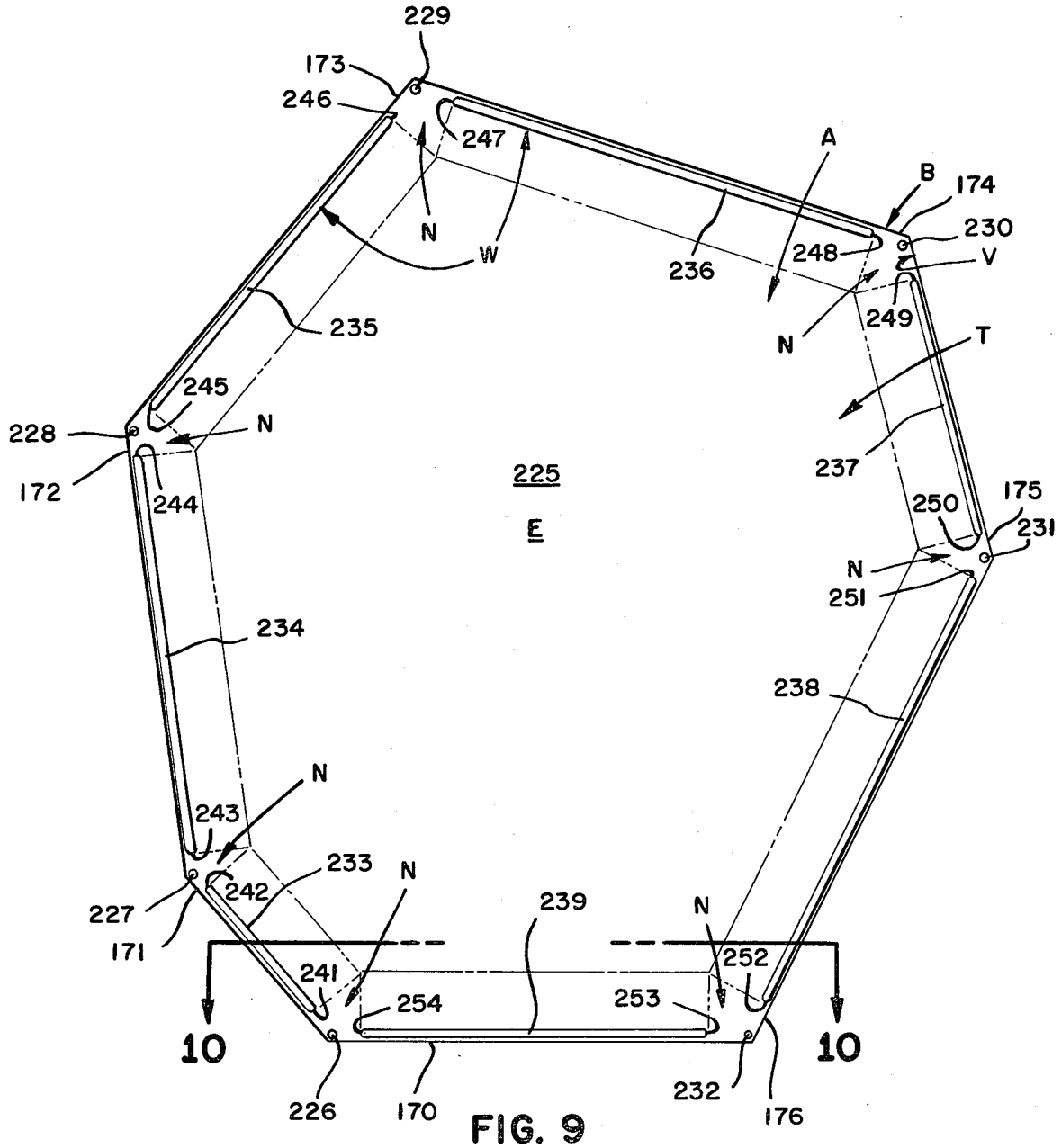
FIG. 9 is a reservoir having the same shape as the reservoir of FIG. 8 with a modified cover. The cover is positioned in an empty reservoir.
Figure 10:
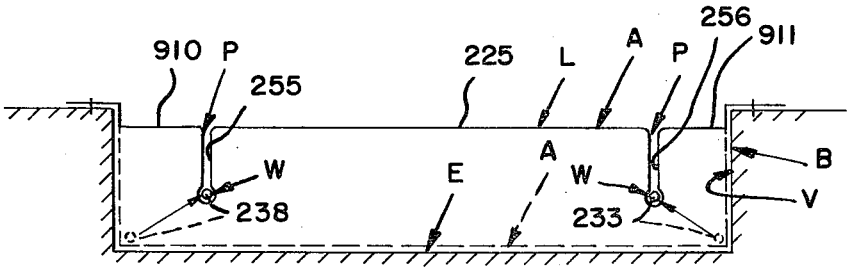
FIG. 10 is a cross sectional view of the reservoir shown in FIG. 20 taken along 10—10. The cover is positioned in a full reservoir.

In Example #4, the reservoir illustrated in FIGS. 9 and 10, is identical to the reservoir illustrated in FIG. 8. Segmented corner weights 226–232 are attached to the cover at the intersection of each non-horizontal wall and extend from substantially the high water level of the reservoir to the generally horizontal bottom E. Segmented weights 233–239 are attached to the cover parallel and adjacent to the respective vertical walls. The ends 241–254 of the segmented weights terminate short of the corner weights and adjacent the non-interference areas N.

The phantom lines in FIG. 9 indicate the portion of the cover which forms the sumps. The central sump is located above weights 233–239.

FIG. 10 shows the positions of the weights taken along line 10—10 when the reservoir is full. Line 10—10 may also be considered to be a section line extending from non-adjacent walls 171 and 176 across the reservoir and sumps 255 and 256 are intersected. With two sumps along each of such segment lines, the weights place substantially all of the cover in tension for all working fluid levels. A single large tensioned plate 225 is formed with peripheral tensioned plates formed between weights 234–239 and sides 170–176 as illustrated by tensioned plates 910 and 911 in FIG. 10.

Figure 12:
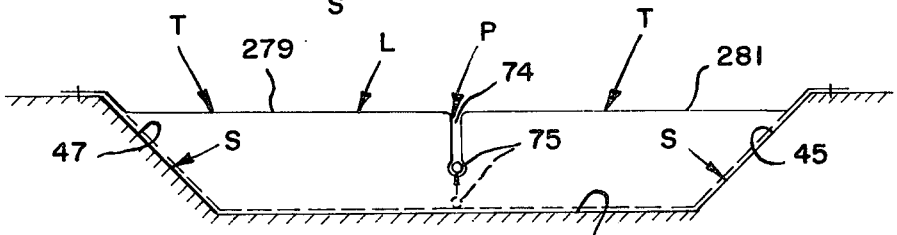
FIG. 12 is a cross sectional view of the reservoir shown in FIG. 11 taken along line 12—12. The cover is positioned in a full reservoir.
Figure 13:
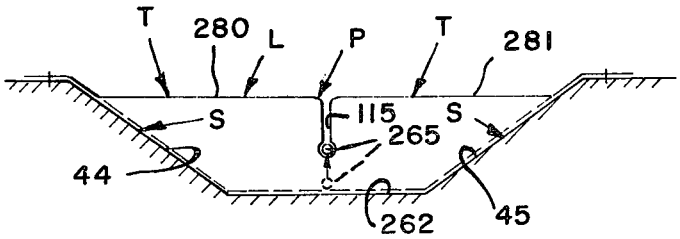
FIG. 13 is a cross sectional view of the reservoir shown in FIG. 11 taken along line 13—13. The cover is positioned in a full reservoir.

In Example #5, illustrated in FIGS. 11–13 the reservoir is formed with four sides, 258–261, four sloped sides 44–47, and a generally horizontal central portion 262. Segmented weights 263–266 extend into the central portion and terminate at ends 268–271. A central line of segmented weights 75 extends toward sides 258 and 260 and terminates at ends 272 and 273.

As shown in FIG. 12, the weighting means creates at least one defined central sump as shown by sump 74 which crosses or is coincident with all section lines extending across non-adjacent sides of the reservoir.

Two non-interference areas 274 and 275 are illustrated in which there are no segmented weights attached. Only spot weights 276 and 277 are attached to the centroid of the respective non-interference areas.

The phantom lines on both sides of the segmented weights indicate the portions of the cover which form the sumps. The area between the sides of the reservoir and the phantom lines indicates the portion of the cover which form tensioned plates 278–281.

Figure 15:
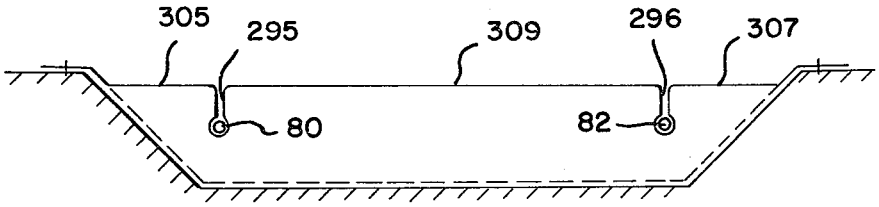
FIG. 15 is a cross sectional view of the reservoir shown in FIG. 14 taken along line 15—15. The cover is positioned in a filled reservoir.

In Example #6, illustrated in FIGS. 14 and 15, the same rectangular reservoir is shown as was illustrated in FIG. 11. Lines of segmented weights 108–111 are attached to the cover at the intersection of the non-horizontal sides and extend from the corners of the reservoir to the toe of the sloping walls and have ends 283–286. Each of the lines of segmented weights at the toe of the sloped walls terminate at ends 287–294.

In this example, the weighting means creates at least one defined sump which crosses or is coincident with all section lines extending across non-adjacent side of the reservoir. In fact, two sumps 295 and 296 are created.

In order to insure that the fold material of the cover in the non-interference areas 297–300 are in tension, spot weights 301–304 may be attached to the cover at the centroid of the non-interference areas. As the reservoir fills, the portions of the cover on either side of the segmented weights move toward each other. The ends of the lines of segmented weights also move toward one another but do not touch with sufficient force to put any substantial stress on the cover in the non-interference areas. The phantom lines on both sides of the lines of segmented weights indicate the portions of the cover used to form the sumps. The areas between the sides and the phantom lines define the portion of the cover used to create tensioned plates 305–309.

Figure 16:
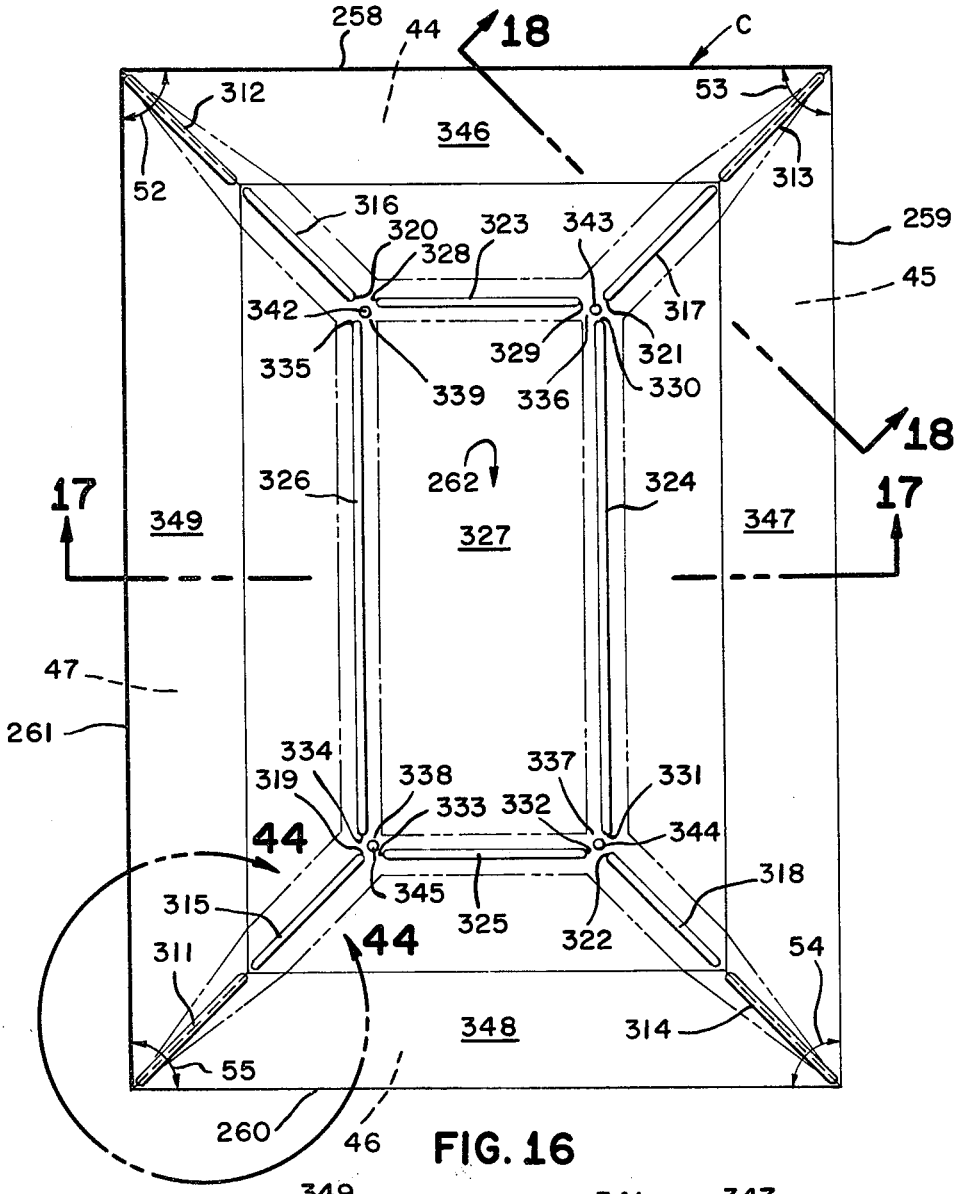
FIG. 16 is a rectangular reservoir having the same shape as the reservoirs in FIGS. 11 and 14 with a modified cover. A cover is positioned in an empty reservoir.
Figure 17:
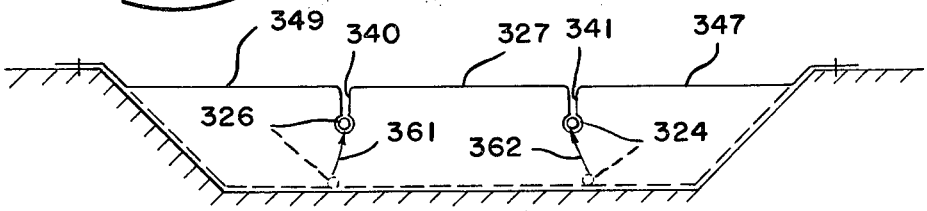
FIG. 17 is a cross sectional view of the reservoir shown in FIG. 16 taken along lines 17—17. The cover is positioned in a filled reservoir.
Figure 18:
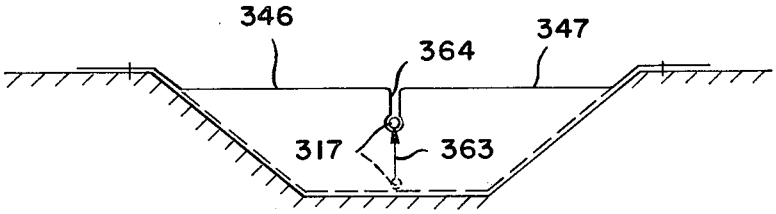
FIG. 18 is a cross sectional view of the reservoir shown in FIG. 16 taken along line 18—18. The cover is positioned in a filled reservoir.

In Example #7, the rectangular reservoir shown in FIGS. 16, 17 and 18 is identical to the slope sided reservoir, shown in FIGS. 11 and 14.

Lines of segmented weights 311–314 are attached to the cover at the intersection of the sloped side and extend from the top reservoir level to the toe of the above. Another set of segmented weights 315–318 extend inwardly in alignment with the previously designated weights and terminate at ends 319–322. Lines of segmented weights 323–326 are attached to the cover in the central portion parallel to the sides and form a rectangular central sump above the weights and a rectangular tensioned plates 327. The weight ends 319–322, and 328–335 terminate at the edges of the non-interference areas 336–339.

As shown by the section 17—17 in FIG. 17, two sumps 340 and 341 cross the section line extending across non-adjacent sides of the reservoir.

Spot weights 342–345 are placed in the centroid of the non-interference areas.

As the reservoir fills, the portions of the cover bounded by the phantom lines representing the sumps approach one another. The lines of segmented weights also approach one another in the non-interference areas but do not touch, place the weight tubes in compression or cause any substantial stress in the cover.

Four tensioned plates 346–349 are formed adjacent the periphery and together with the large rectangular tensioned plate 327 cover substantially the entire reservoir.

FIG. 17 illustrates the invention when the reservoir is filled. Arrows 361 and 362 indicate the path of weights 326 and 324 as the reservoir fills and the weights move from the bottom, where the weights are indicated in broken line. Note that the weights move in a curved but defined path.

In FIG. 18, the path of weight 317 is indicated by the arrow 63 as the reservoir fills and the weights move from the bottom, where the weights are indicated in broken line. Note that the weights move in a vertical defined path and form sump 364.

Figure 19:
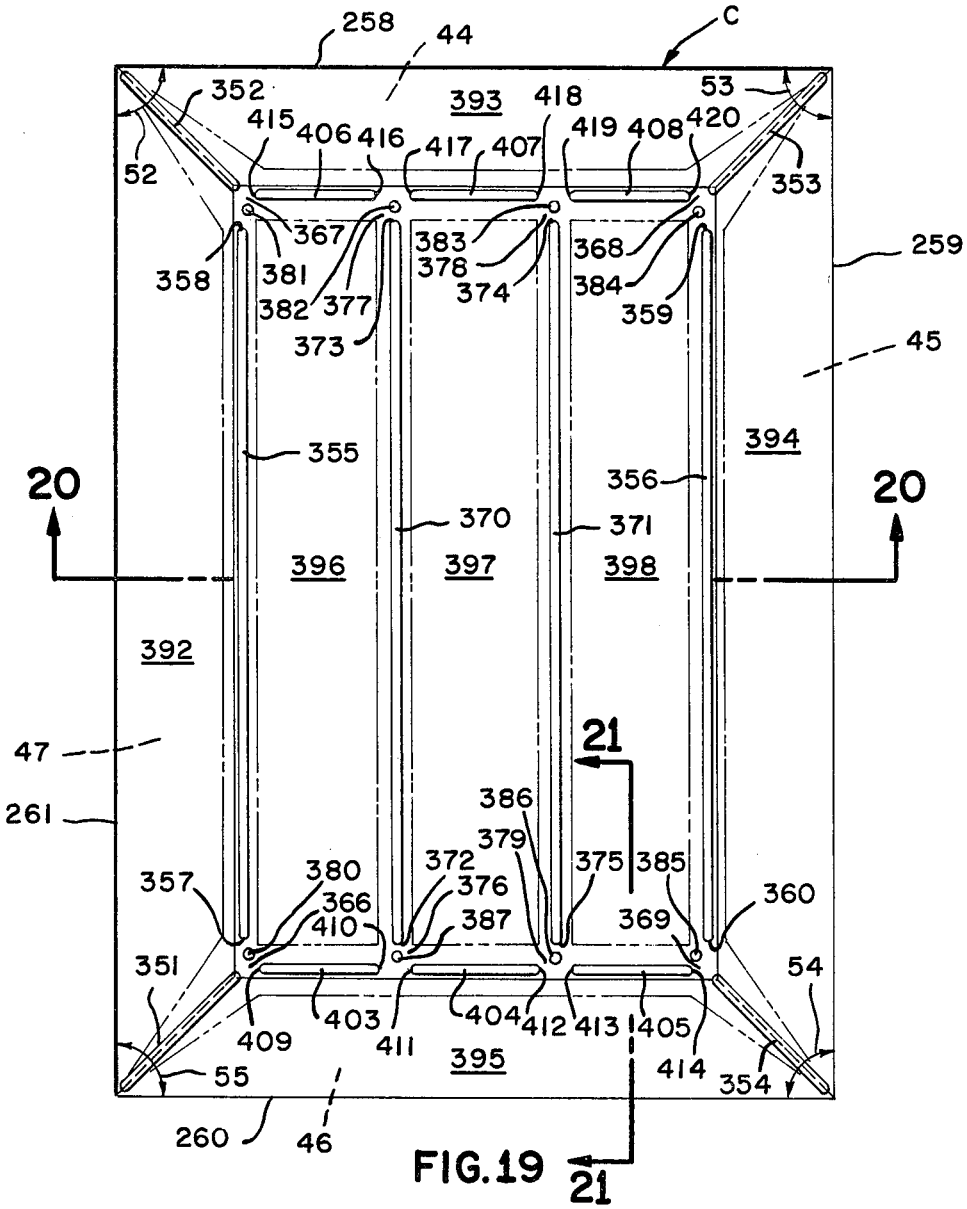
FIG. 19 is a plan view of a rectangular reservoir having the same shape as the reservoirs shown in FIGS. 11, 14, and 16. A modified form of the cover is shown positioned in an empty reservoir.
Figure 20:
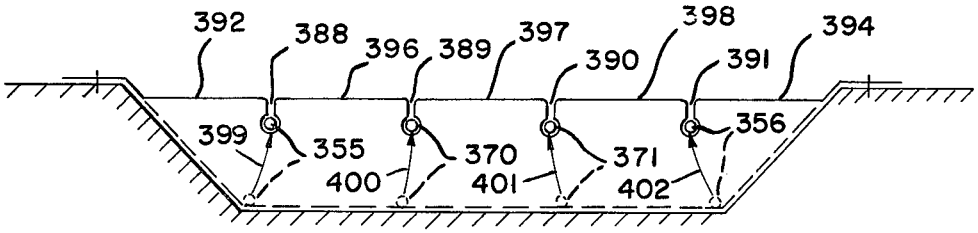
FIG. 20 is a cross sectional view of the reservoir shown in FIG. 19 taken along line 20—20. The cover is shown with the reservoir filled.
Figure 21:
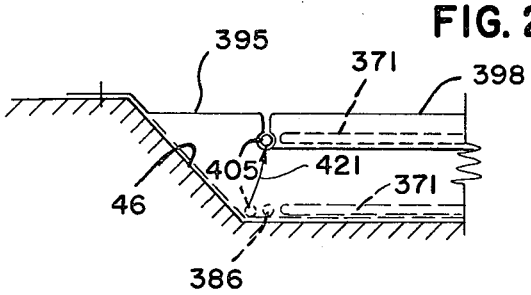
FIG. 21 is a cross sectional view of a portion of the reservoir shown in FIG. 19 taken along line 21—21. The cover is shown with the reservoir filled.

In example #8 a slope-sided rectangular reservoir is shown in FIGS. 19–21 having the same shape as the reservoir illustrated in FIGS. 11–16. Segmented weights 351–354 are located at the intersection of the non-horizontal sides and segmented weights 355 and 356 are connected to the cover at the intersections of the longest sloped sides with their ends 357–360 terminating at the non-inference areas 366–369.

The horizontal area may be formed with additional sumps by attaching weights 370 and 371 parallel to segmented weights 355 and 356 which have ends 372–375 terminating at the edge of non-interference areas 376–379.

Short segmented weights 380–387 may be placed in the centroid of the non-interference areas to facilitate sump formation.

Segmented lines of weights 403–408 are attached to the cover parallel to sides 258 and 260. Weight ends 409–420 terminate at the edge of the non-interference areas 366–369 and 376–379.

As illustrated in FIG. 20, at least one sump is formed which crosses a section line between non-adjacent sides. In fact, four sumps 388–391 are formed.

In the example, tensioned plate members are formed in cover portions 392–398 and sumps are formed at each line of segmented weights. All of the sumps interconnect at all working levels of the reservoir. A central sump is formed above weights 355–356, and 403–406.

As the reservoir fills, the portions of the cover bounded by the broken lines which indicate sump forming portions approach one another. The ends of the lines of segmented weights also approach one another but do not touch so as to place the weight tubes in compression or cause substantial stress in the cover.

As shown in FIG. 20, weights 355, 370, 371 and 356 follow a curved path as indicated by arrows 399–402 as the reservoir fills.

As shown in FIG. 21 weights 405 follow a defined path indicated by the arrow 421 as the reservoir fills and weights 371 rise from the bottom to an elevated position as shown.

Example #9, as shown in FIG. 22, illustrates still another arrangement of the segmented weights to form pre-programmed interconnecting sumps and tensioned plate members over the entire surface of a rectangular reservoir identical in shape to the reservoir illustrated in FIGS. 11–19 and previously described.

A section line across any non-adjacent side is crossed by at least one sump, and in this case by two sumps.

As the reservoir fills, sumps form below the segmented weights and four tensioned plates 427–430 are formed. The phantom lines indicate the boundries of the cover which form the sumps and the parallel lines are drawn toward one another until they nearly touch when the reservoir is full. The ends of the lines of segmented weights approach in the non-interference area but do not touch or compress so as to substantially stress the cover.

Weights 99–102 are attached to the cover along the intersection of the non-horizontal sides and bisect corner angles 52–55.

Figure 23:
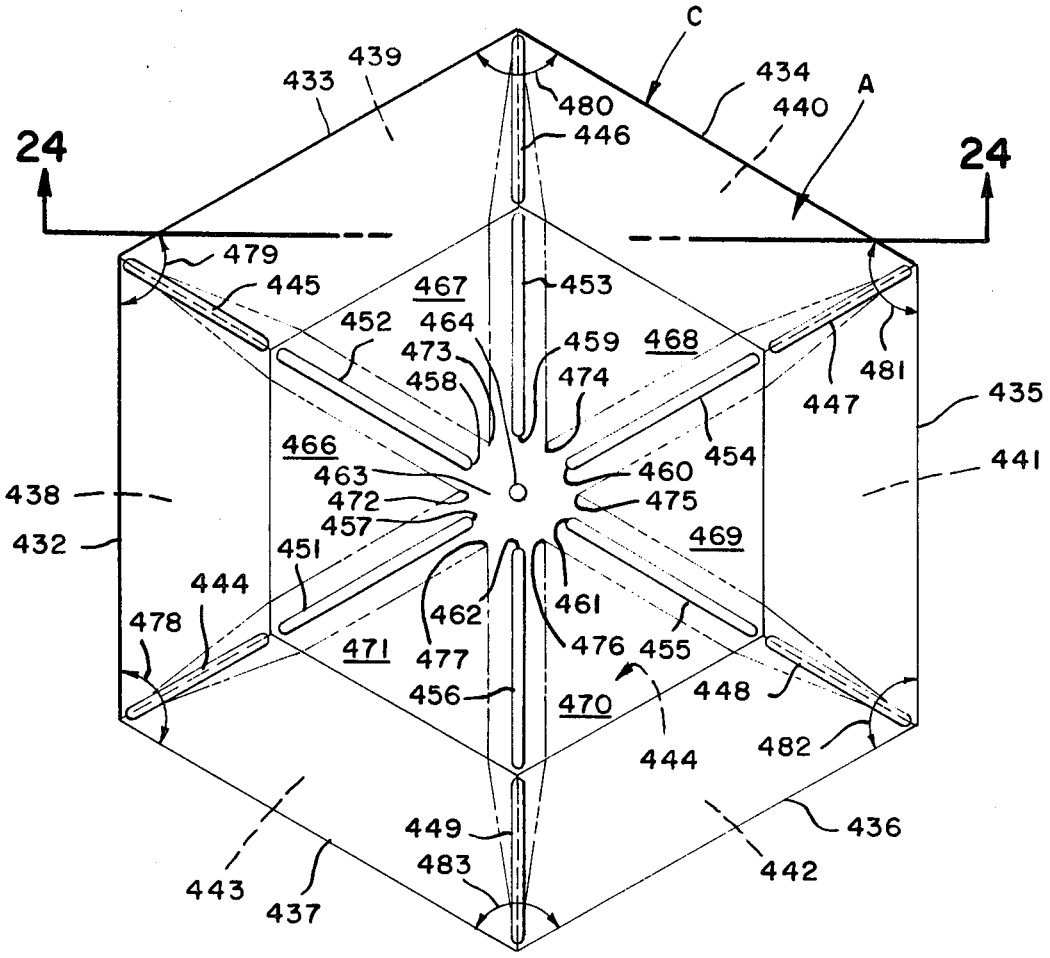
FIG. 23 is plan view of a hexagonal reservoir with sloped slides. The cover is positioned in an empty reservoir.
Figure 24:
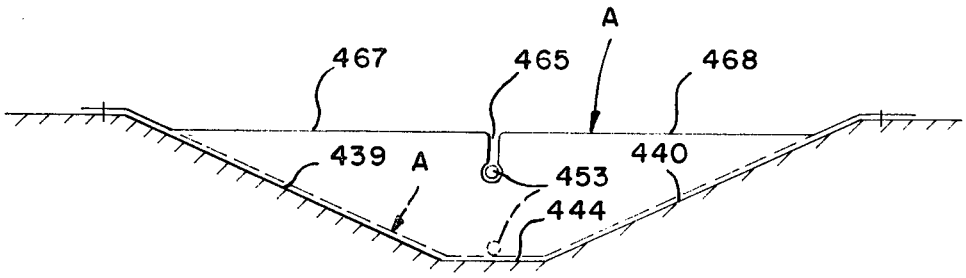
FIG. 24 is a cross sectional view of the reservoir shown in FIG. 23 taken along line 24—24. The cover is positioned in a filled reservoir.

In Example #10, a hexagonal reservoir illustrated in FIGS. 23 and 24 having sides 432–437, six sloping sides 438–443 and a hexagonal horizontal central portion 444 is illustrated. Lines of segmented weights 444–449 are attached to the cover at the intersection of each of the non-horizontal sides and extend from the upper water level to the toe of the slope. Lines of segmented weights 451–456 extend from the ends of the previously named lines of weights toward the center of the reservoir and terminate at ends 457–462 at the edge of the non-interference area 463. A spot weight 464 may be placed at the centroid of the non-interference area to insure that a central sump will be formed at the intersection of all of the sumps.

A section line across any two non-adjacent sides is crossed by at least one sump as illustrated in FIG. 24. In this case the section line crosses sump 465.

As the reservoir fills, tensioned plates 466–471 are formed. The phantom lines define the cover portions used to form the sumps adjacent the segmented weights.

The lines of segmented weights move toward the non-interference area but the ends do not touch so that the weights are not placed in compression or introduce substantial stress in the cover.

As shown in FIG. 24 the phantom lines show the position of the cover and weight 453 when the reservoir is empty.

Every point on the tensioned plates moves normal to the side to which it is attached as previously described. Thus in the illustration, the apexes 472–477 of the triangular tensioned plates adjacent the non-interference area move toward the center of the reservoir but do not touch one another. Weights 444–449 bisect angles 478–483 formed by the intersection of sides 432–437.

Figure 25:
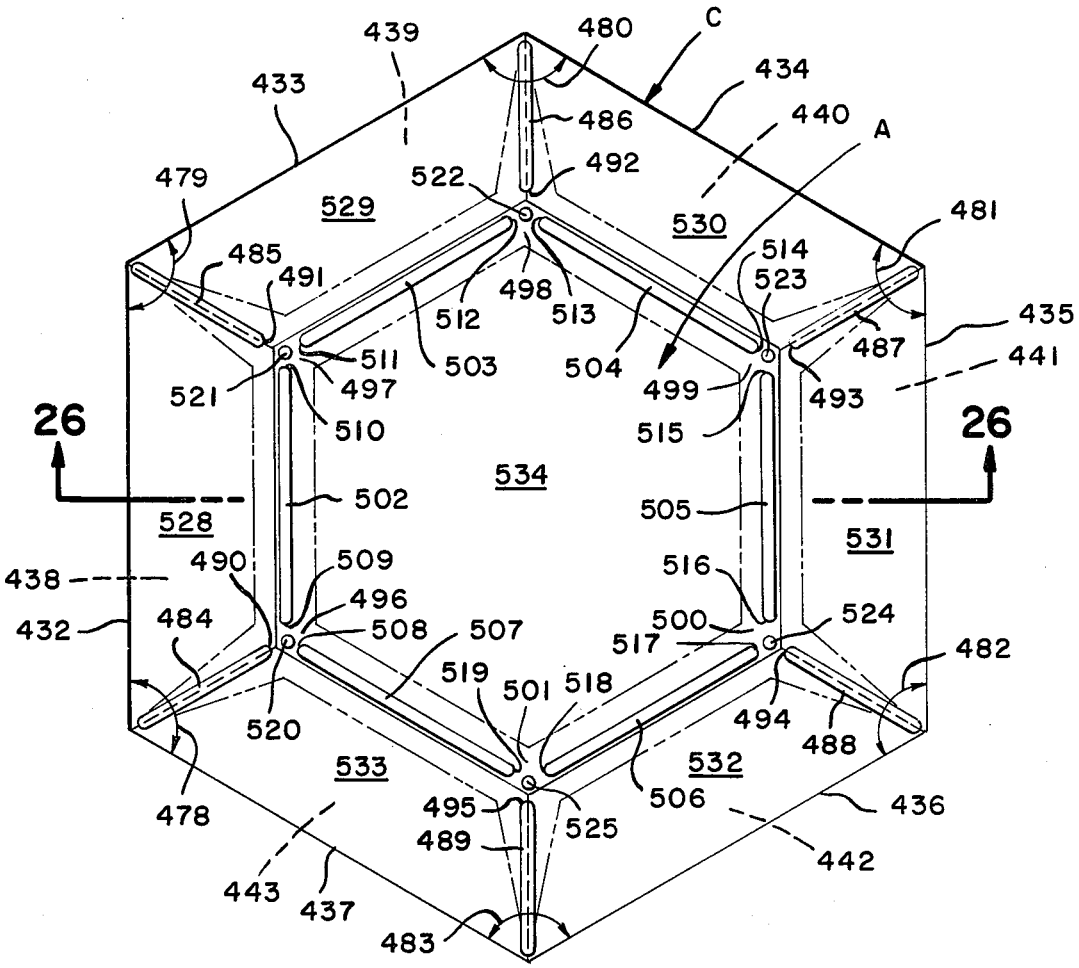
FIG. 25 is a hexagonal reservoir having the same shape as the reservoir shown in FIG. 23. A modified form of the cover is shown positioned in an empty reservoir.
Figure 26:
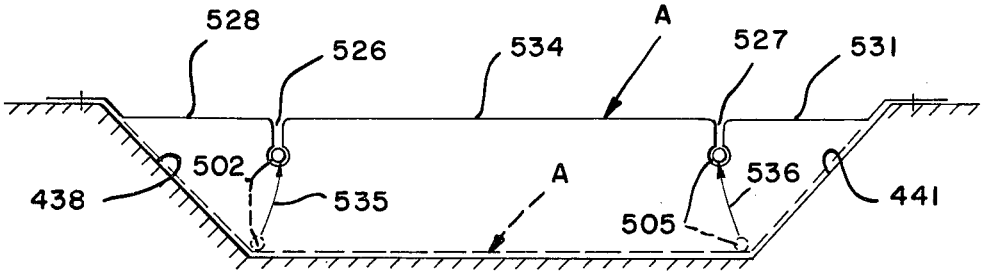
FIG. 26 is a cross sectional view of the reservoir shown in FIG. 25 taken along line 26—26. The cover is positioned in a filled reservoir.

In Example #11, a hexagonal reservoir illustrated in FIGS. 25 and 26 and identical in shape to the reservoir in FIG. 23 is illustrated. Lines of segmented weights 484–489 are attached to the cover at the intersection of the non-horizontal sides and extend from the upper water level of the reservoir to the toe of the slope; with ends 490–495 terminating at the non-interference areas 496–501. Lines of segmented weights 502–507 are attached to the cover at the intersections of the non-horizontal sides and the horizontal central portion with ends 508–519 terminating at the edge of the non-interference areas. A central sump is formed above these weights. Short spot weights 520–525 are placed at the centroid of the non-interference areas to insure the interconnection of all of the sumps. Every section line across two non-adjacent sides is crossed by at least one sump, and in this form of the invention such section lines are crossed by at least two sumps 526 and 527, as illustrated in FIG. 26. When the reservoir is empty, the phantom lines show the position of the cover and the weights. The weights 502 and 503 move along a path shown by arrows 535 and 536.

Six tensioned plates 528–533 are formed adjacent the sides and a large hexagonal plate 534 in the central portion. The sumps are formed adjacent the segmented weights and the areas formed between the phantom lines form the sumps.

The segmented weight move toward each other in the non-interference areas but do not touch so that they do not cause compression in the weights or induce substantial stress in the cover.

Figure 27:
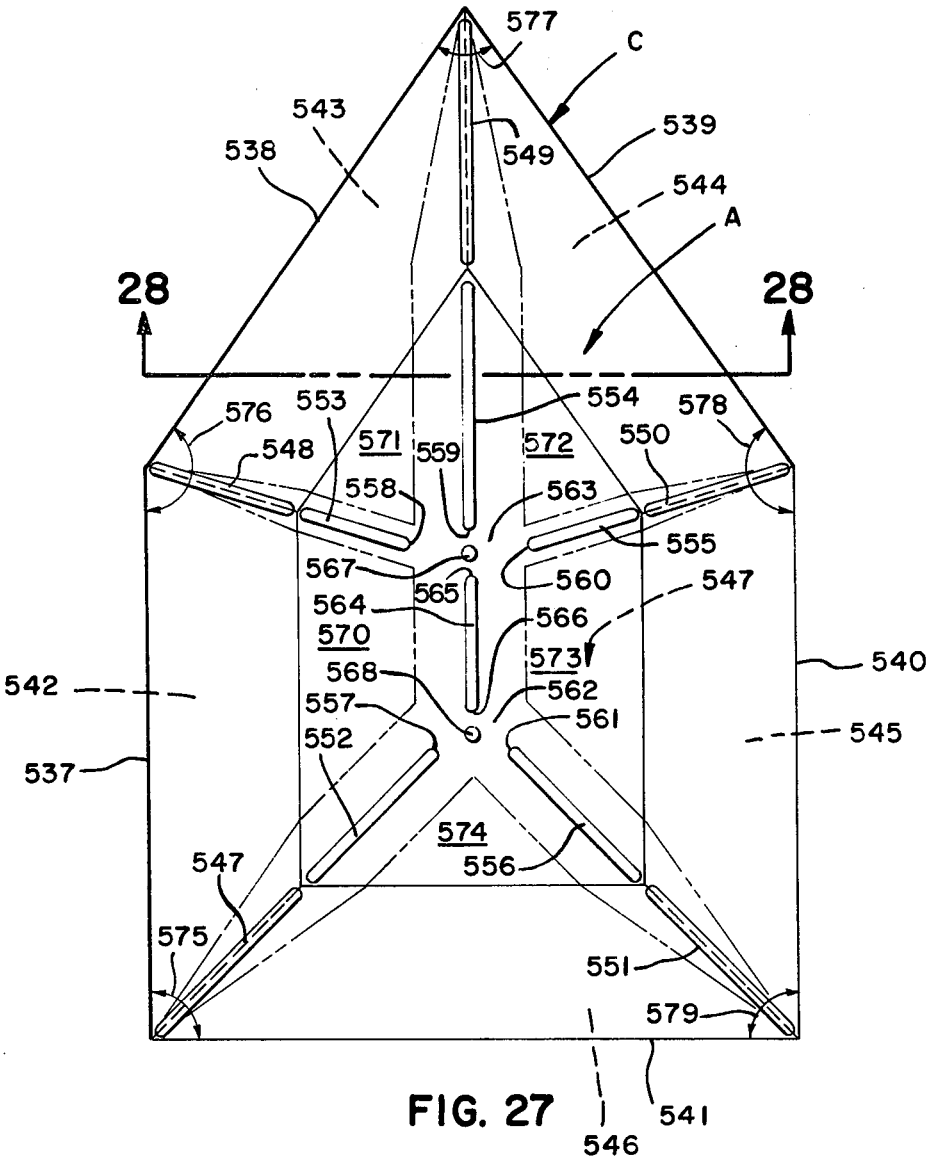
FIG. 27 is a plan view of a 5 sided reservoir having slopping sides. The cover of the present invention is shown in an empty reservoir.
Figure 28:
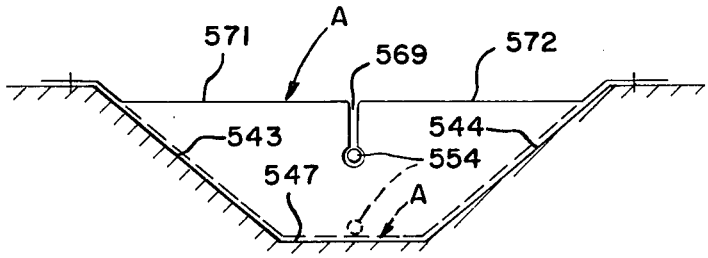
FIG. 28 is a cross sectional view of the reservoir shown in FIG. 27 taken along line 28—28. The cover is positioned in a filled reservoir.

In Example #12, illustrated in FIGS. 27 and 28, a five (5) sided reservoir is illustrated having sides 537–541 with sloped sides 542–546 with a central horizontal portion 547. Lines of segmented weights 547–551 are connected to the cover at the intersection of the non-horizontal sides extending from the upper water level to the toe of the slope. Lines of segmented weights 552–556 extend toward the middle of the reservoir and terminate at ends 557–561 at the edges of non-interference areas 562 and 563. A line of segmented weights 564 extends along a centerline of the reservoir forming a central sump and terminates at ends 565 and 566 at the edge of the non-interference areas 562 and 563. Short spot weights 567 and 568 may be placed at the centroid of the non-interference areas to insure interconnection of all the sumps formed above the segmented weights.

Section lines crossing any two non-adjacent sides are crossed by at least one sump 569 as shown in FIG. 23.

As the reservoir fills, five tensioned plates 570–574 are formed. The cover portions between the areas indicated in phantom line form the sumps adjacent the segmented weights. The weights are pre-programmed so that they approach each other in the non-interference areas but do not touch so as to compress each other or place stress in the cover.

In FIG. 28, the phantom lines indicate the position of the cover and weight when the reservoir is empty.

Segmented weights 547–551 intersect angles 575–579 formed by the intersection of the peripheral sides.

Figure 29:
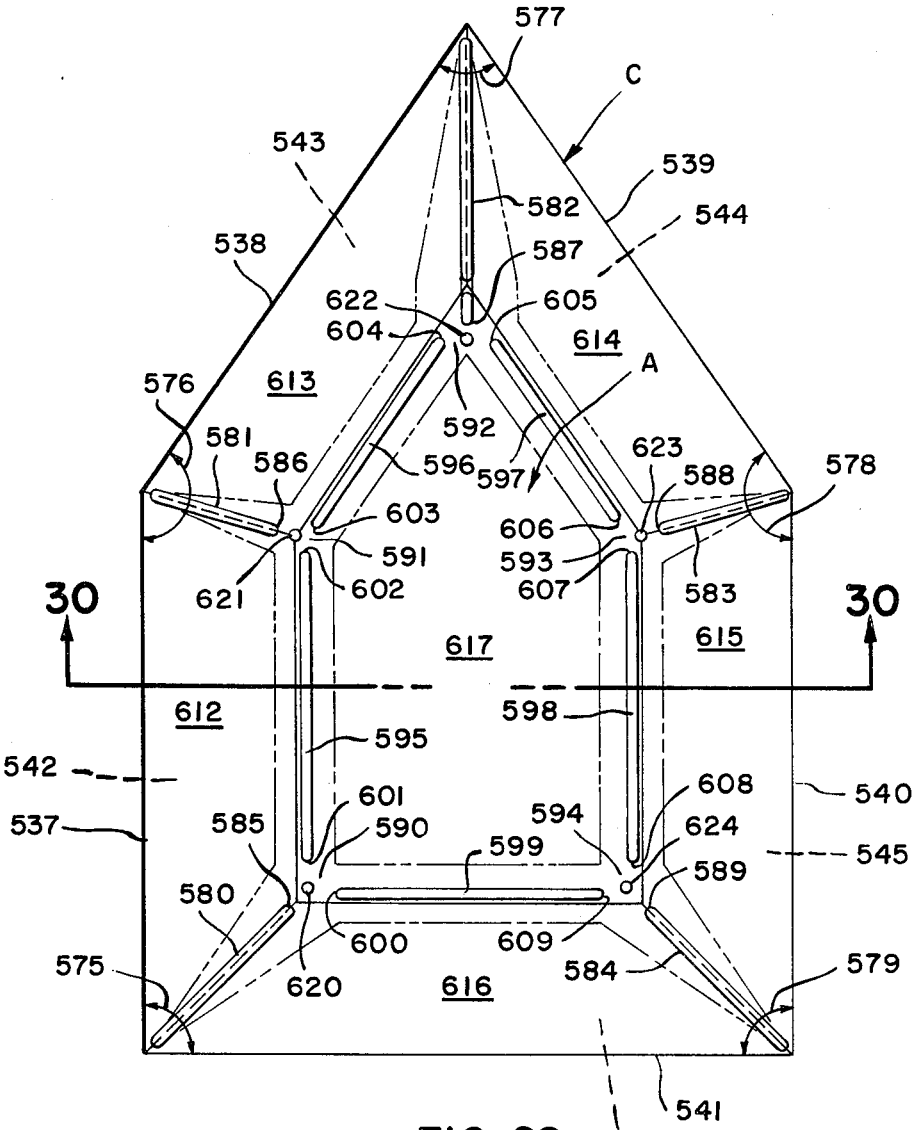
FIG. 29 is a plan view of a five sided reservoir having the same shape as the reservoir of FIG. 27. A modified form of the cover is positioned in an empty reservoir.
Figure 30:
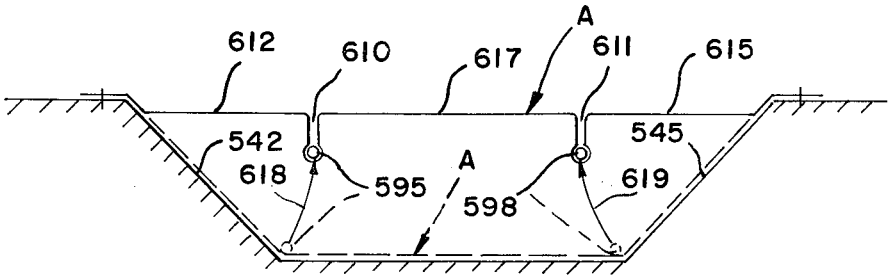
FIG. 30 is a cross sectional view of the reservoir shown in FIG. 29 along line 30—30. The cover is positioned in a filled reservoir.

In example #13, a five (5) sided reservoir identical in shape to the reservoir shown in FIGS. 27 and 28 is illustrated in FIGS. 29 and 30 but has a different arrangement of weights. Lines of segmented weights 580–584 are attached to the cover at the intersection of the non-horizontal sides from the upper water level to the toe of the slope and terminate at ends 585–589 at the edge of the non-interference areas 590–594. Lines of segmented weights 595–599 are attached to the cover at the intersection of the sloping walls and the horizontal central portion with their ends 600–609 terminating at the edge of the non-interference areas. Spot weights 620–624 are located at the centroid of the non-interference areas. Any section line crossing from one adjacent side to the other intersects at least one sump and in fact in this reservoir two sumps 610 and 611 cross the section line as illustrated in FIG. 30.

The entire reservoir is divided into six tensioned plates 612–617 bounded by the peripheral edges and ten interconnected sumps located above the lines of segmented weights.

As the reservoir fills, the cover portions between the phantom lines are drawn toward one another and form the sumps. The ends of the segmented lines of weights approach one another in the non-interference areas but do not compress one another or place tension in the cover. A central sump is formed above weights 595–599.

The phantom lines in FIG. 30 represent the position of the cover and weights when the reservoir is empty. Arrows 618 and 619 indicate the path taken by the weights as the reservoir fills.

Figure 31:
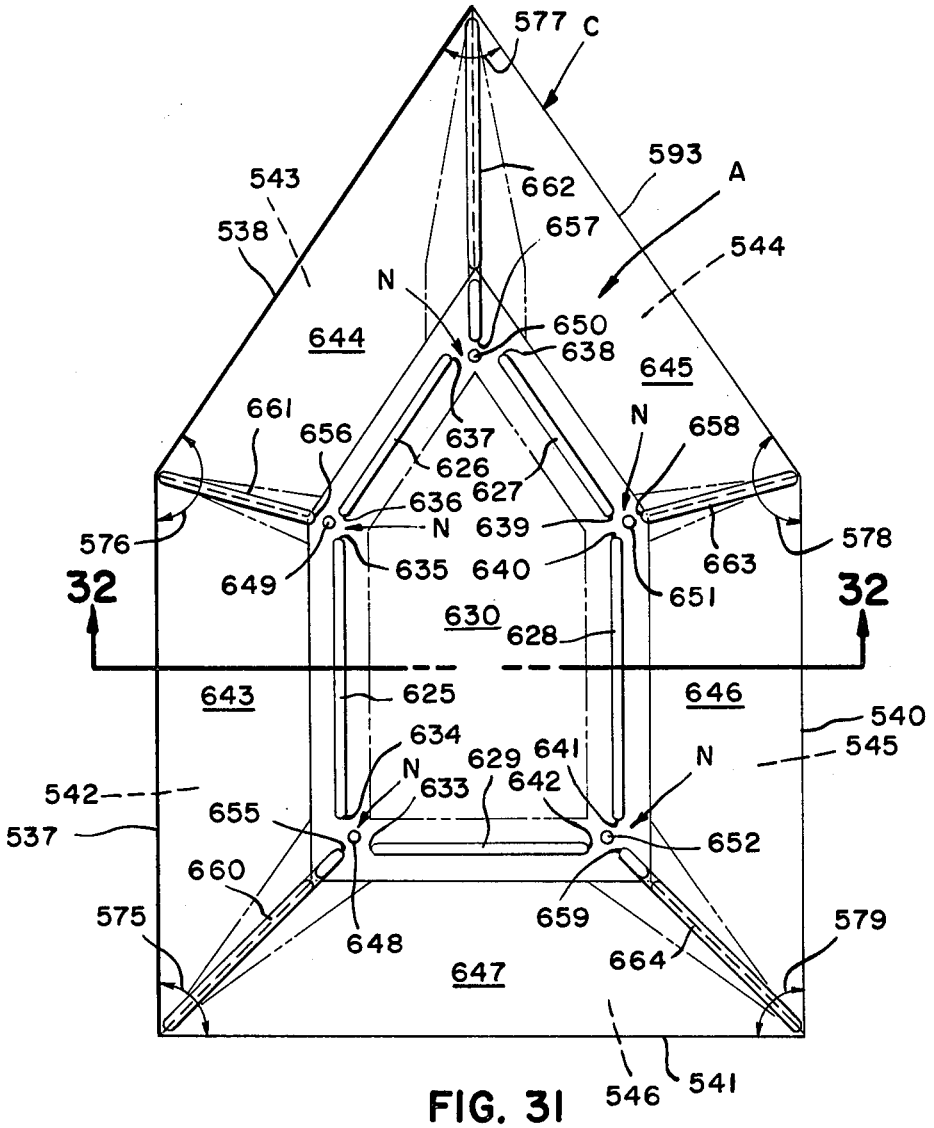
FIG. 31 is a plan view of a reservoir having the same shape as the reservoirs shown in FIGS. 27 and 29. A modified form of the cover is positioned in an empty reservoir.
Figure 32:
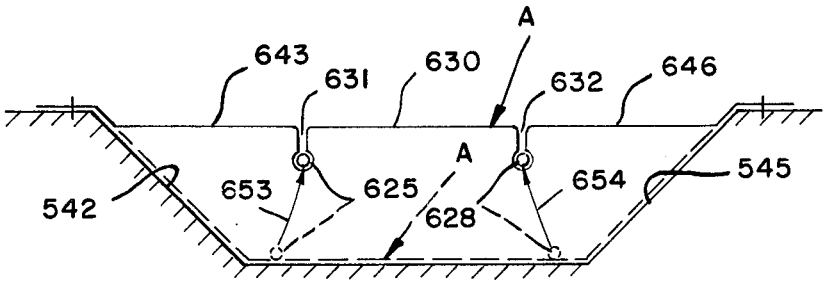
FIG. 32 is a cross sectional view of the reservoir shown in FIG. 31 taken along line 32—32. The cover is positioned in a filled reservoir.

In Example #14, the shape of the reservoir illustrated in FIGS. 31 and 32 is identical to the shape of the reservoir shown in FIGS. 27–30. The construction of the cover is different in that the segmented weights 625–629 forming the central sump and the central tensioned plate 630 are moved out into the horizontal part of the reservoir. Corner weights 660–664 bisect the corners of the reservoir and are attached at the intersection of the non-horizontal sides. As shown in FIG. 32 two sumps 631 and 632 cross the section line extending from any two non-adjacent sides.

As the reservoir fills, the ends 633–642 of the lines of segmented weights approach each other but do not touch so as to cause substantial compression or stress in the weights.

The areas of the cover indicated by the phantom lines form the sumps and the phantom line portions approach one another as the filling proceeds.

Five tensioned plates 643–647 are formed adjacent the sides in addition to the center tensioned plate.

Spot weights 648–652 are attached to the centroid of the non-interference areas.

In FIG. 32, the position of the cover and weights are shown in phantom line when the reservoir is empty. As the reservoir fills, the weights follow the path of the arrows 653 and 654.

A section line crossing the reservoir between any two non-adjacent sides is crossed by at least one sump. As illustrated in FIG. 32, two sumps 631 and 632 are formed.

Figure 33:
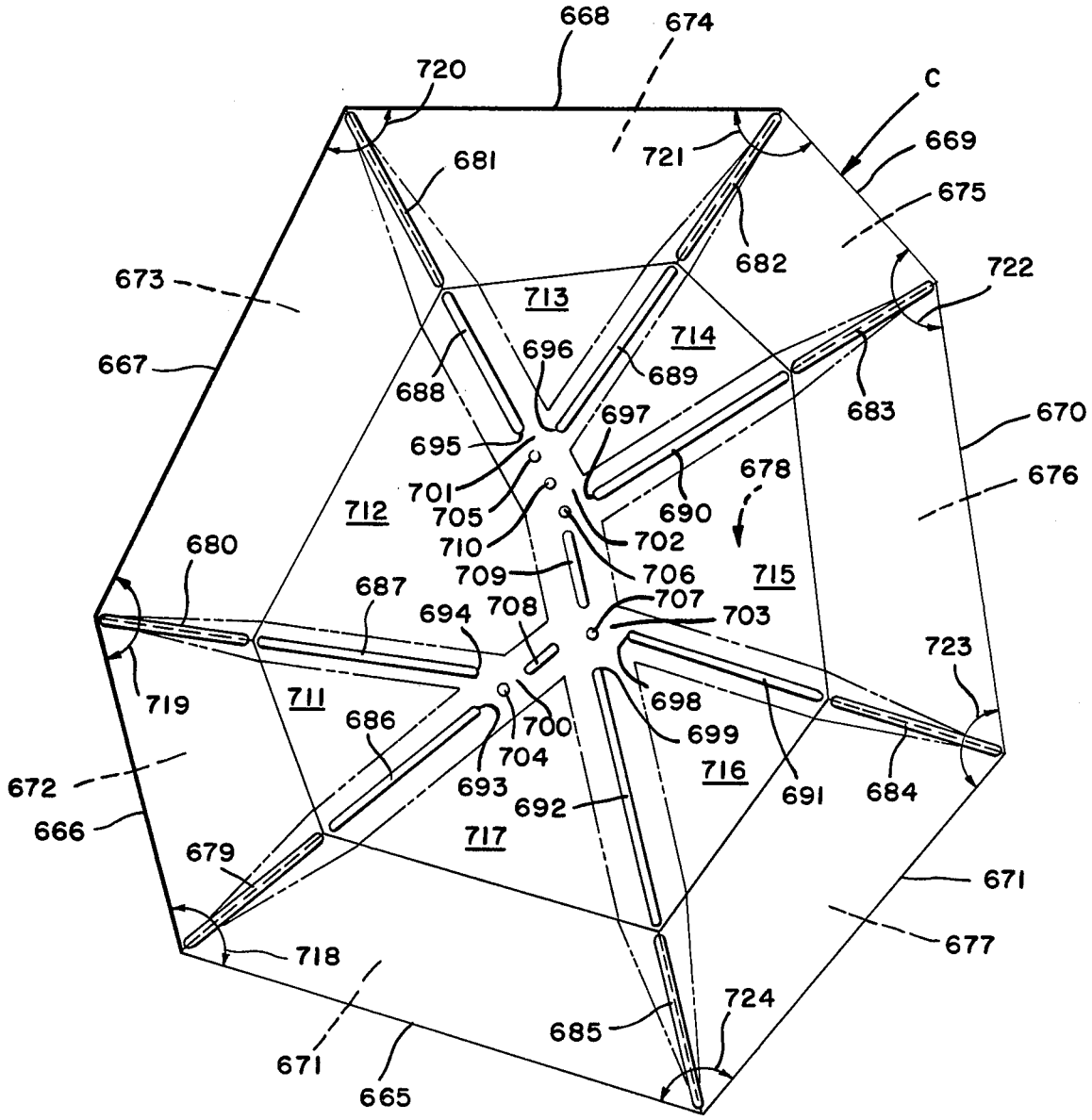
FIG. 33 is a plan view of a polygonal reservoir having unequal sides and slopping side walls. The cover is positioned in an empty reservoir.

In Example #15, an unequal sided polygon having seven sides 665–771 is illustrated in FIG. 33 having sloped sides 671–677 and a generally horizontal central portion 678. Lines of segmented weights are attached to the cover at the intersections of the sloped sidewalls and are designated 679–685.

Segmented weights 686–692 extend into the central horizontal portion of the reservoir. The lines of weights terminate at ends 693–699 at the edges of non-interference areas 700–703. Short segment spot weights 704–707 are placed in the centroid of the interference areas N to insure the formation of the sumps at the non-interference areas. Elongated weights 708 and 709 and short spot weight 710 are attached to the cover to insure the interconnection of all of the sumps at all working level conditions.

Tensioned plates 711–717 are formed which cover the entire surface and are bounded by the periphery of the reservoir and the sumps.

The areas of the cover used to form the sumps are designated by phantom lines. As the reservoir fills, the phantom line areas approach one another. The segmented weights adjacent the non-interference areas approach each other but do not touch; avoiding compression in the weights and stress in the cover. The tensioned plate areas follow the same movement pattern previously discussed with each point on a tensioned plate moving away from and normal to the side to which the plate is attached.

Figure 34:
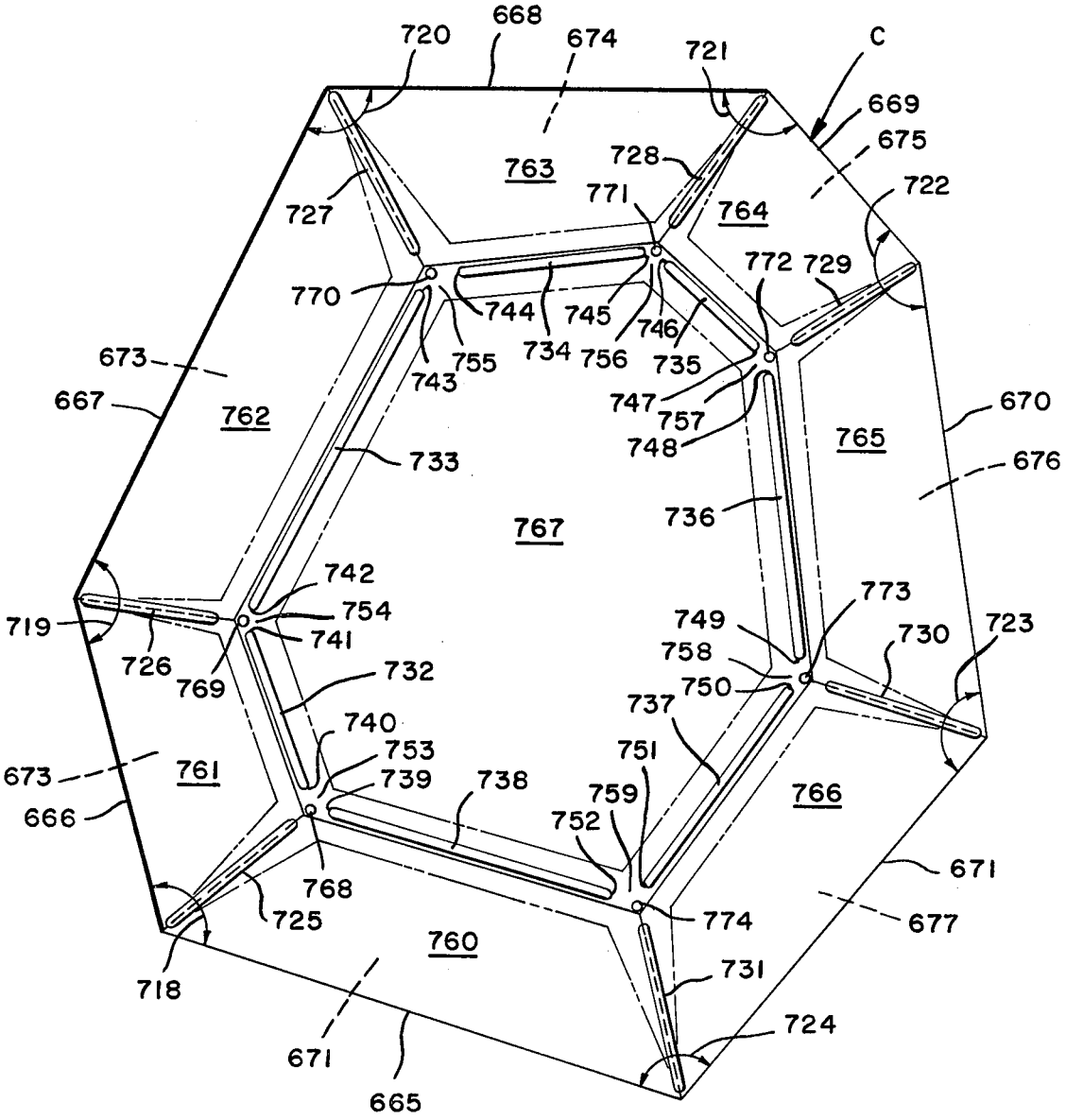
FIG. 34 is a plan view of a reservoir having a shape identical to the reservoir shown in FIG. 33. A modified form of the cover is positioned in an empty reservoir.
Figure 35:
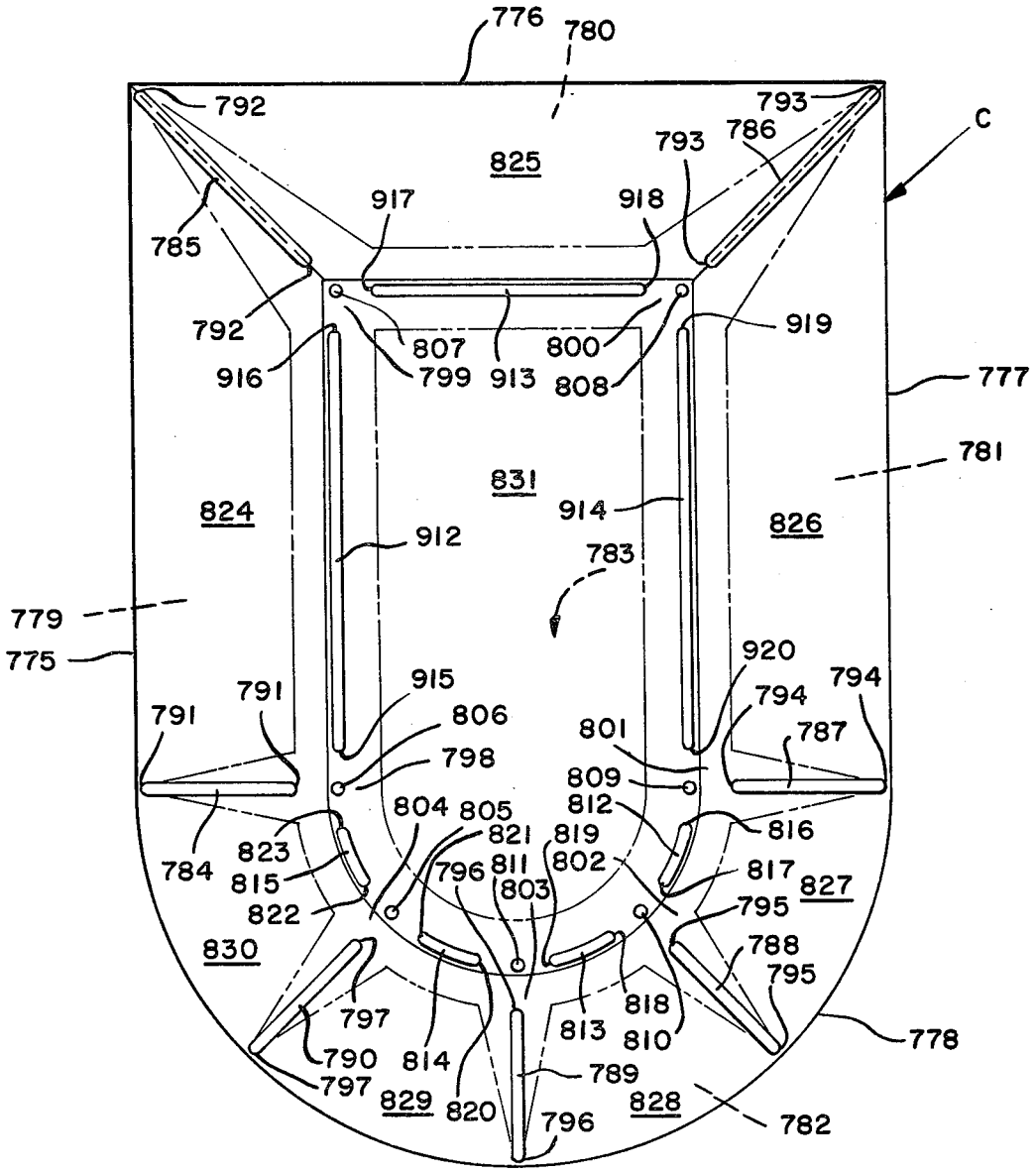
FIG. 35 is a plan view of a reservoir having three (3) straight sides and 1 curved side with a shope wall and flat mid-portion. The cover is shown in an empty reservoir.

Note that the segmented lines of weights bisect the corner angles 718–724;

In Example #16, the same unequal sided polygon reservoir is illustrated in FIG. 34 as was illustrated in FIG. 33. A different arrangement of weights are illustrated. As in the previous example, segmented weights 725–731 are attached to the cover along the intersection of the sloping sides and bisect the intersection of the three intersecting planes. The difference is that lines of segmented weights 732–738 are attached to the cover parallel to the sides of the reservoir and at the toe of the slope. Each of the lines of weights terminate at ends 739–752 at the edge of the non-interference areas 753–759.

Eight tensioned plates 760–767 are formed which cover the entire area of the reservoir and are bounded by the sides and interconnected sumps formed above the weight members. Spot weights 768–774 are positioned at the centroids of the non-interference areas.

A section line across any two non-adjacent sides is crossed by at least one sump.

A central reservoir is formed above weights 732–738.

As the reservoir fills, the sumps form from the cover material bounded by the phantom lines set forth in the illustration. The ends of the segmented weights adjacent the non-interference areas approach but do not touch thereby avoiding compression in the weights and damage to the cover due to stress of the weight attachment points.

In Example #17, a reservoir with three sides 775–777 and a curved side 778, is illustrated. The reservoir is also formed with sloping sides 779–782 and a generally horizontal portion 783 in the central part. Lines of segmented weights 784–787 are attached to the cover at the intersection of the non-horizontal sides and extend form the upper water level to the toe of the sloped sides so as to bisect the intersection of the three planes of the reservoir walls. Additional lines of segmented weights 788–790 are attached to the cover in the curved wall portion and extend from the upper water level to the toe of the slope. The lines of weights terminate at ends 791–797 at the edges of the non-interference areas 798–804. Short spot weights may be attached to the centroids of each of the non-interference areas as illustrated by weights 805–811. In the curved sloped wall, a series of short segmented weights 812–815 may be placed between the non-interference areas. The segmented weights terminate at ends 816–823 at the edges of the non-interference areas.

Lines of segmented weights 912–914 are attached to the cover along the toe of the sloped sides 779–781, parallel to sides 775–777 and terminate at ends 915–920 at the edge of the non-interference areas 798–801.

Tensioned plates 824–830 are formed which cover the entire surface area of the reservoir and are bounded by the sides of the reservoir and interconnected sumps which are formed above the weights. A large tensioned plate 831 is formed in the middle of the reservoir.

The phantom lines indicate the portion of the cover used to form the sumps. The lines of segmented weights move toward one another in the non-interference areas but do not touch; avoiding compression of the weights and stress damage to the cover. There is some gathering of the cover material in the curved portions of the sump, but generally the operation of the cover in forming the sumps and tensioned plates is similar to straight side reservoirs.

A section lines across any two non-adjacent sides is crossed or coincident with at least one sump.

A central sump is formed above weights 912–914 and 812–815.

In Example #8 as illustrated in FIGS. 36–39 a reservoir is illustrated with five sides 832–836, a vertical wall 921, four sloped sides 57–60 and a central five sides horizontal bottom 837.

The segmented weights 61–63 extend into the central portion 837 and terminate at ends 838–840 at the edge of the non-interference area 841. A short or spot weight 842 is attached to the cover at the centroid of the non-interference area.

Along the vertical wall 921, lines of segmented weights 843 and 844 are attached to the cover at the foot of the vertical wall and extend beyond weights 70 and 71 along the vertical wall and terminate at ends 845 and 846 at the edge of non-interference area 847. Still another elongated segmented weight 848 is attached to the cover at the vertical wall and extends from the high level point of the water to the bottom of the reservoir. A line of segmented weights 849 extends along the center line of the reservoir and terminates at ends 850 and 851 at the edge of the non-interference areas 847 and 841.

Figure 39:
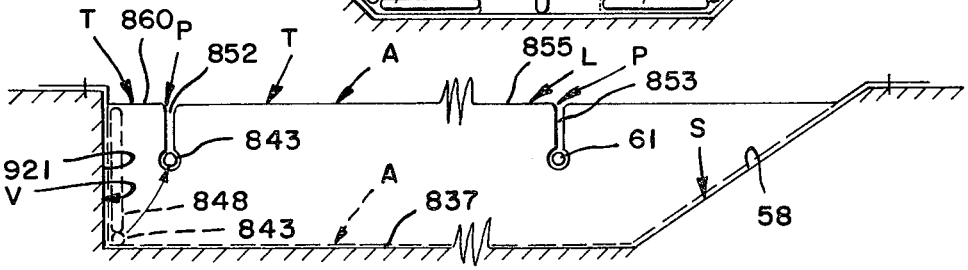
FIG. 39 is a cross sectional of a portion of the reservoir shown in FIG. 36—36 taken along line 39—39. The cover is positioned in a filled reservoir.

The weighting means create at least two defined sumps crossing or coincident with substantially all section lines extending across non-adjacent sides of the reservoir where one of the sides is vertical. As shown in FIG. 39, sumps 852–853 are formed.

Figure 37:
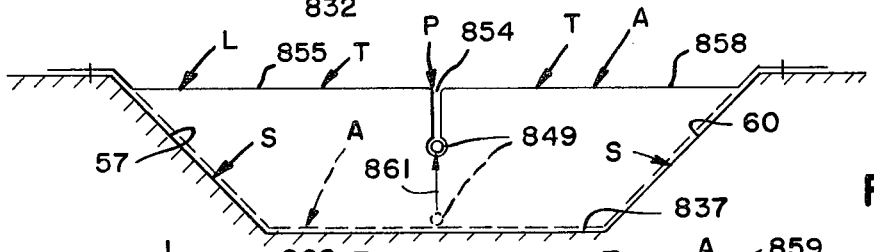
FIG. 37 is a cross sectional view of the reservoir shown in FIG. 36 taken along line 37—37. The cover is positioned in a filled reservoir.
Figure 38:
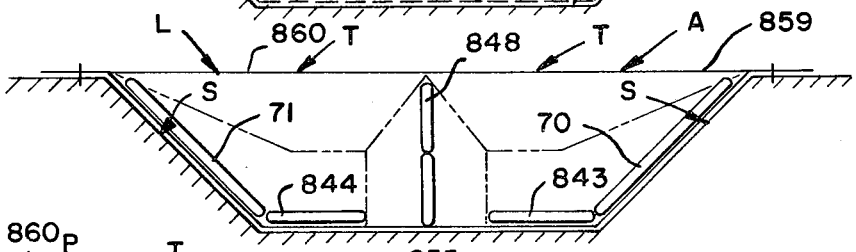
FIG. 38 is a cross sectional view of the reservoir shown in FIG. 36 taken along line 38—38. The cover is positioned in an empty reservoir.

As shown in FIG. 37, sump 854 is formed. Weight 849 moves along a path indicated by arrow 861.

The weighting means create in the cover member a plurality of tensioned plates 855–860 for the entire range of working fluid level conditions which cover substantially the entire area of the reservoir.

A central sump is created above weight 849.

Figure 36:
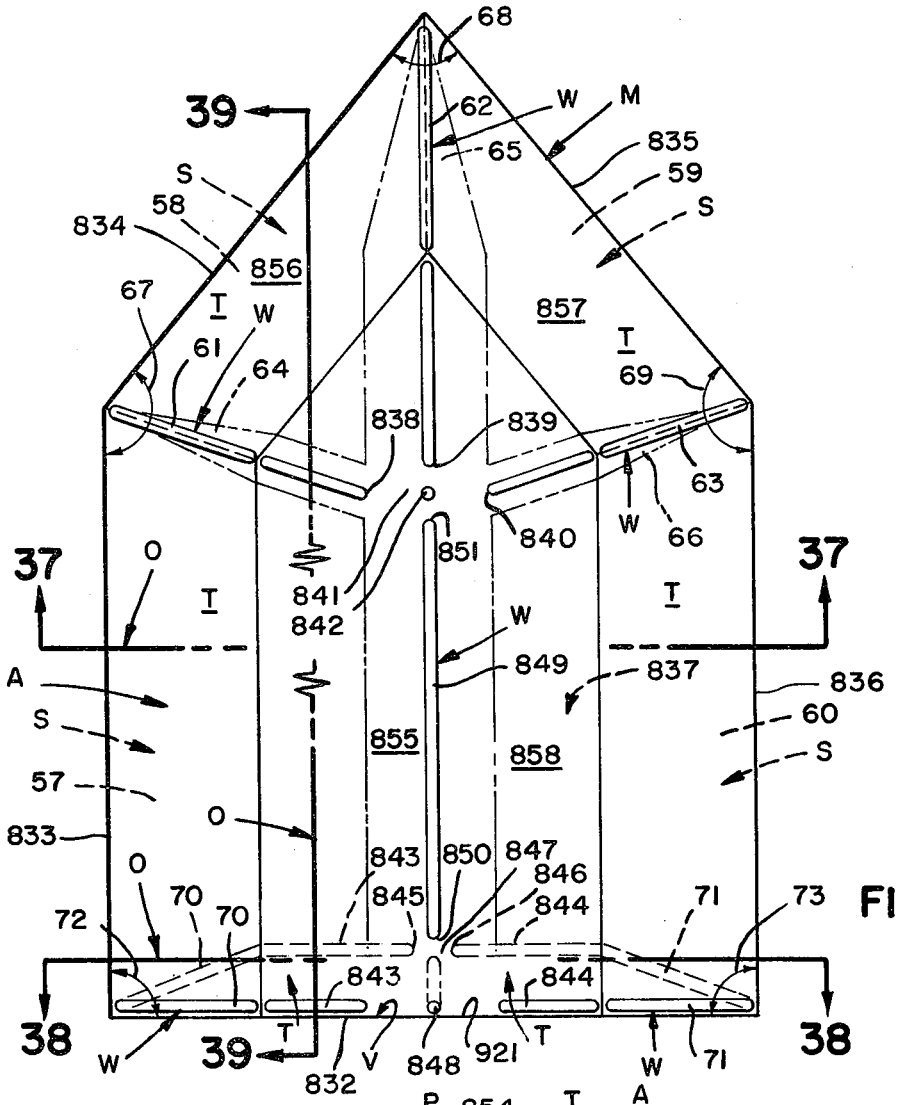
FIG. 36 is a plan view of a five (5) sided reservoir having a vertical side wall and a plurality of slopping side walls. The cover is positioned in an empty reservoir.

The phantom lines in FIG. 36 represent the portions of the cover which form the sumps as the reservoir fills.

Figure 40:
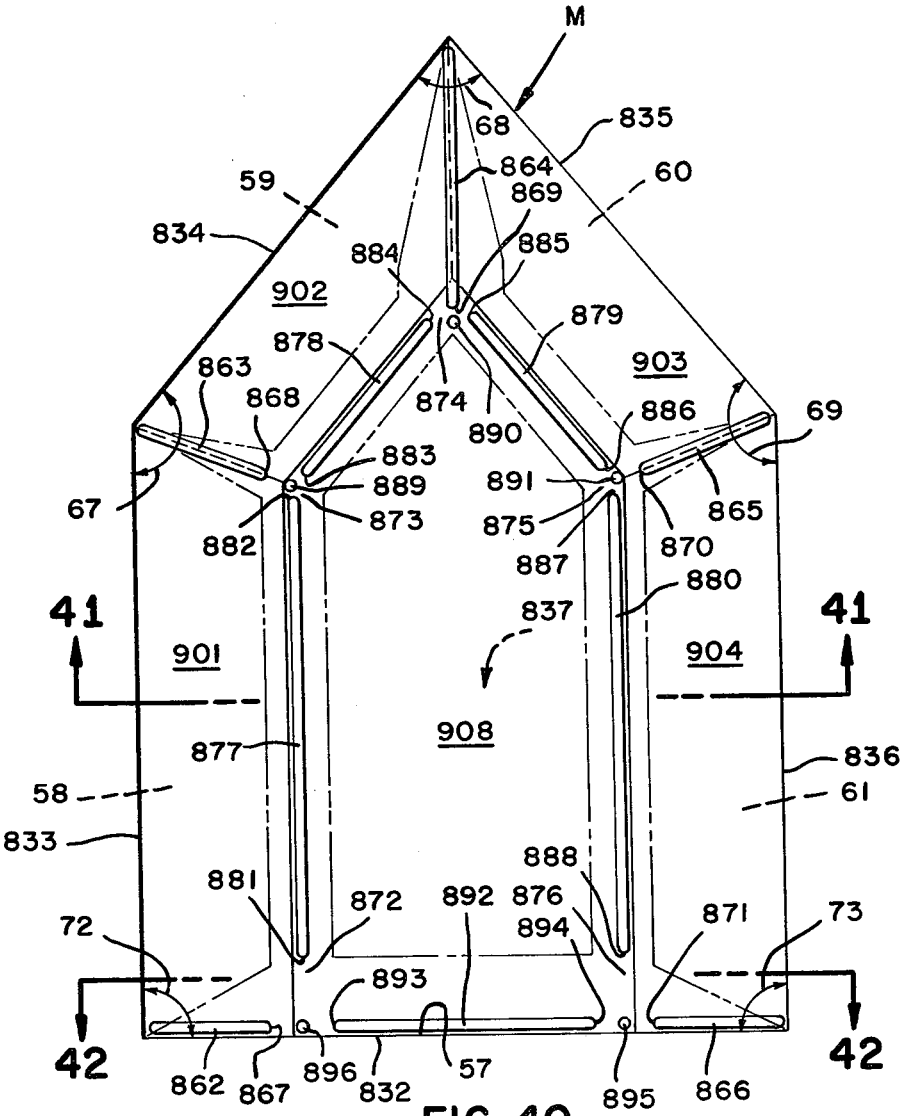
FIG. 40 is a plan view of a reservoir having the identical shape of the reservior shown in FIG. 36. A modified form of the cover is shown in an empty reservoir.
Figure 41:
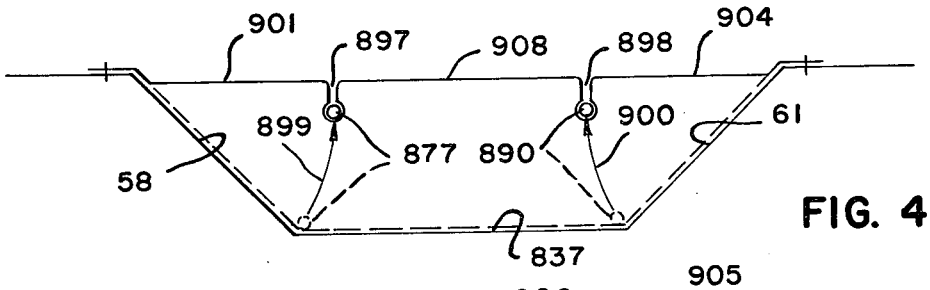
FIG. 41 is a cross sectional view of the reservoir shown in FIG. 40 taken along line 41—41. The cover is positioned in a filled reservoir.
Figure 42:
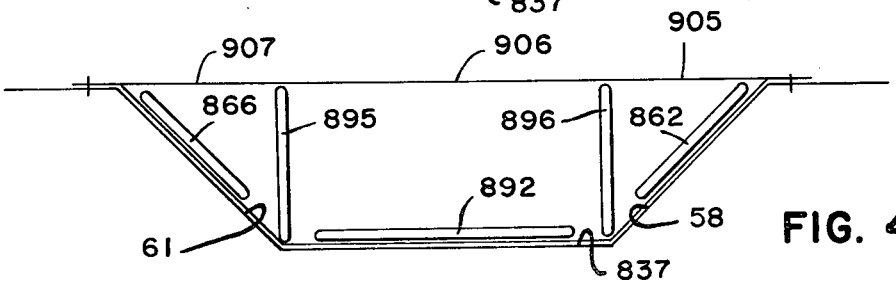
FIG. 42 is a cross sectional view of the reservoir shown in FIG. 40 taken along line 42—42. The position of the cover is shown in an empty reservoir.

In Example #19, as shown in FIGS. 40–42 a reservoir identical with the reservoir illustrated in FIGS. 36–39 is disclosed. Like parts carry identical numbers. Some of the weights, however, are attached at different locations. Segmented weights 862–866 are attached to the cover at the intersection of each pair of non-horizontal sides and have ends 867–871 which terminate at the edge of non-interference areas 872–876. Lines of segmented weights 877–880 are attached to the cover parallel to the sides at the toe of the sloping side walls and terminate at ends 881–888 at the edge of the non-interference areas. Short spot weights 889–891 are attached to the cover at the centroids of the non-interference areas 872–876. Segmented weights 892 are attached to the cover parallel to the vertical side along the bottom and terminate at ends 893 and 894 at the edge of the non-interference areas 872 and 876. Segmented weights 895 and 896 are attached to the vertical wall from the top water level to the bottom of the reservoir.

Tensioned plates 901–908 are formed and cover substantially the entire reservoir.

A central sump is formed above weights 877–880 and 892.

A section line across any two non-adjacent sides is crossed or coincides with at least one sump where both sides are sloping. In FIG. 41, two sumps 897 and 898 are actually formed. Weights 877 and 890 follow the paths shown by arrows 899–900 as the reservoir fills.

Where one of the non-adjacent sides crossed by a section line is vertical, two sumps are crossed.

As in the previous examples, the phantom lines indicate the portion of the cover used to form the sumps. As the reservoir fills, the broken lines approach one another and the lines of segmented weights in the non-interference areas also approach one another, but without touching so as to cause substantial compression in the weights or stress in the cover.

Figure 45:
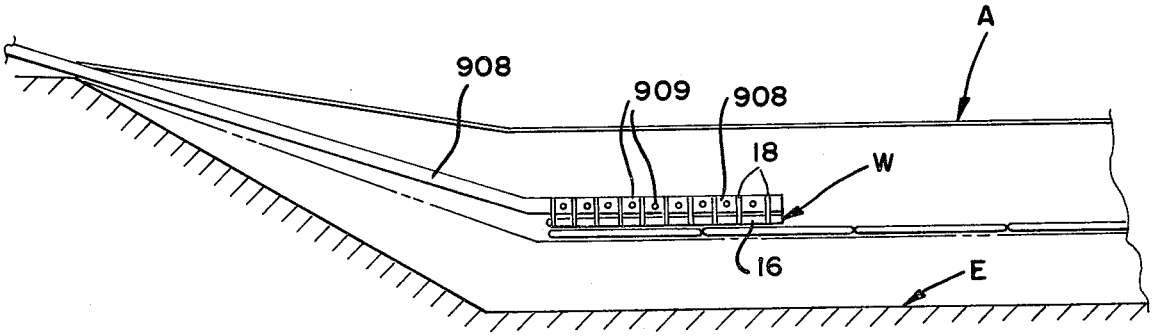
FIG. 45 is a cross sectional view of the portion of the reservoir shown in FIG. 44 taken generally along line 45—45.
Figure 46:
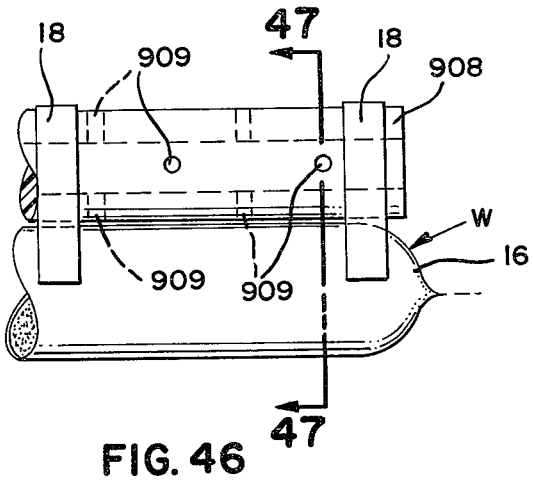
FIG. 46 is a side view of a portion of a typical weight member and suction hose.
Figure 47:
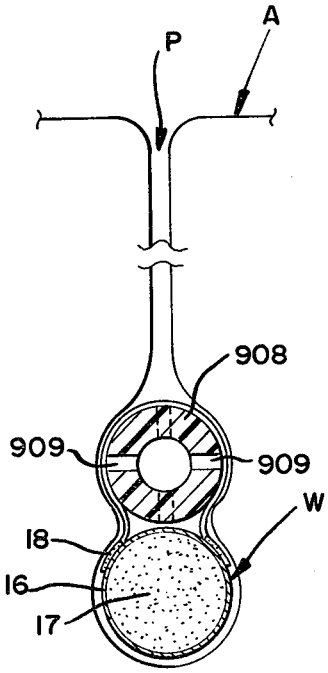
FIG. 47 is a cross sectional view of the weight and suction hose shown in FIG. 46 taken generally along line 47—47.

As shown in FIGS. 45–47 the hoses 908 for draining the water from the sumps may be connected directly to the weights. Since the hoses are flexible they can assume the same configuration of the lines of segmented weights. The hoses may be connected to the weight tubes by flexible strap material of the same type used to form the cover. Holes 909 may be formed in the hose at intervals, and the water withdrawn from the sumps along a substantial portion of their length.

All of the forms of the present invention are uniquely adapted to hasten evaporation of surface water and minimize pumping. For example, referring to FIG. 3, it may be seen that as surface water collects in sump 37, the walls of sump 37 will spread apart at the top. Weight 33 will be lifted and the sump 37 will spread apart at the top. Weight 33 will be lifted and the sump will become more shallow. Pumping of the sump can be used to remove the surface water, but evaporation will also remove the surface water given sufficient time. The fact that the sump is widened at the top provides more surface area exposed to the atmosphere for evaporation to take place.

Figure 48:
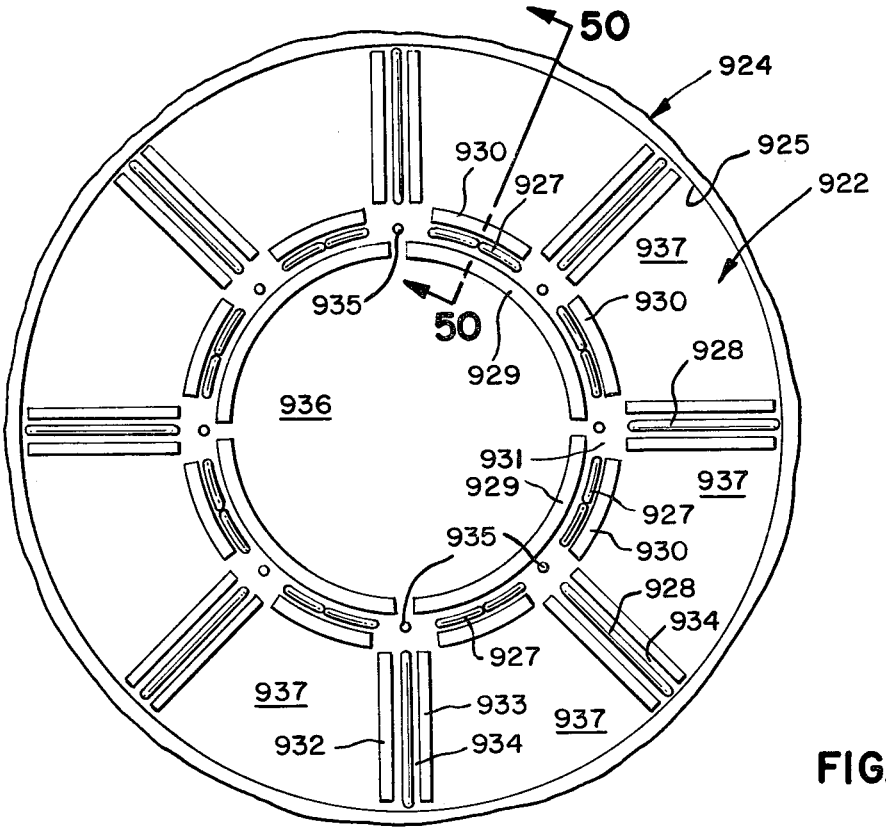
FIG. 48 is a plan view of the cover of the present invention positioned in a full circular and vertical sided reservoir.
Figure 49:
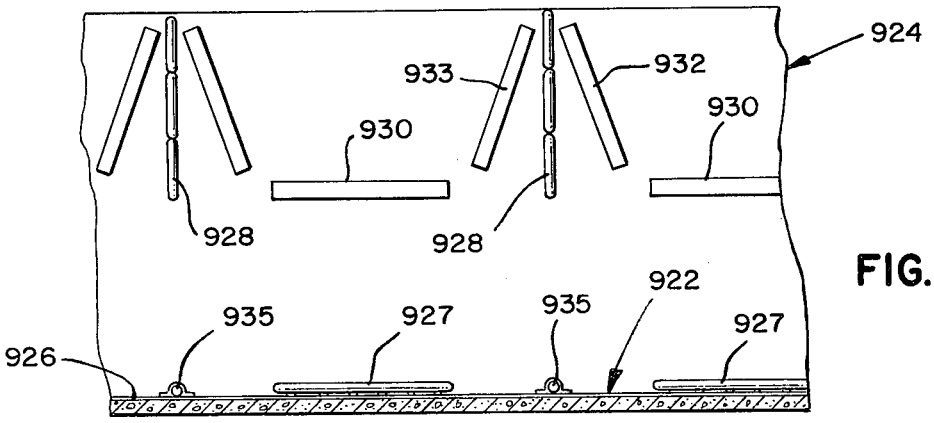
FIG. 49 is a cross section of a portion of the reservoir shown FIG. 50 taken along line 49—49.
Figure 50:
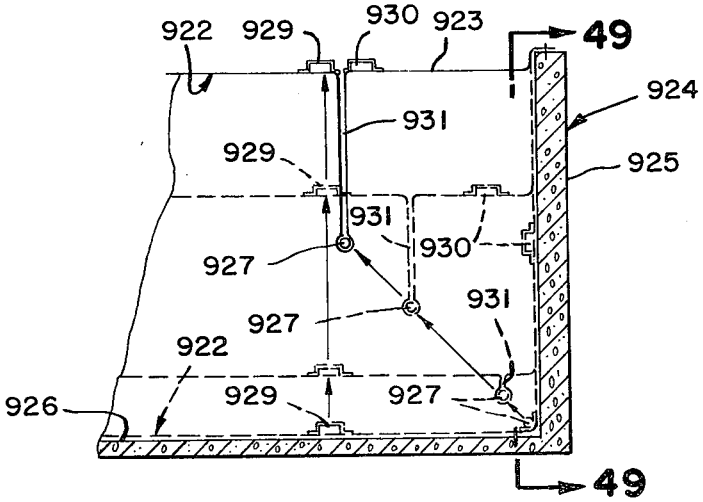
FIG. 50 is a cross section of the portion of the reservoir taken along line 50—50 of FIG. 48. The broken lines show the positions of the cover in empty, partially empty and substantially full water level positions.

In example #20, as shown in FIGS. 48–50, a tensioned plate reservoir cover 922 is disclosed for placement upon the fluid surface 923 of an open reservoir 924 having substantially vertical sidewalls 925, a substantially horizontal bottom wall 926 and having a curvilinear shape. The weighting means, such as segmented weights previously described, includes a series of weights 927 connected to the cover at a location adjacent the intersection of the vertical wall and the bottom wall when the cover rests in the empty reservoir forming segments for a ring.

The weighting means also includes a plurality of annularly spaced weights 928 attached to the cover extending from the periphery radially toward the center of the reservoir and terminating at points on the cover a distance less than one half the height of the vertical wall.

Curved floats 929 and 930 may be spaced from weights 927 to provide protection for workmen walking near sump 931.

Floats 932 and 933 may be attached on either side of weights 928 to protect workmen working near sumps 934. As shown in FIG. 49, floats 932 and 933 are attached at an angle to weights 928. As the reservoir fills, the floats become parallel as shown in FIG. 48.

Spot weights 935 are attached to the cover so that as the reservoir fills they will insure that the excess cover material will sink and permit interconnection of circular sump 931 at each point of intersection with straight line sumps 934.

FIG. 50 illustrates the function of weights 927 to form sump 931. When the reservoir is empty, weight 927 is preferably on the bottom of the reservoir and float 930 is attached part way up the sidewall. As the reservoir fills, all portions of the cover are placed in tension from the lowest fluid elevation to the fullest level. The tensioned cover is formed with a central plate 936 and a plurality of segmented plates 937.

In summary, workmen can walk on every part of the reservoir at all fluid levels.

Another form of cover 938 for a curvilinear reservoir 939 is illustrated in examples 21 illustrated in FIGS. 51–54.

The reservoir has vertical walls 940 and a flat bottom 941. Segmented weights 942 are attached to the cover at locations spaced inwardly from the intersection of the vertical and bottom walls when the cover rests in an empty reservoir forming a segmented ring. The weighting means also includes a plurality of annularly spaced weights 943 attached to the cover and extending from the periphery to the intersection of the vertical and bottom walls when the reservoir is empty.

Figure 52:
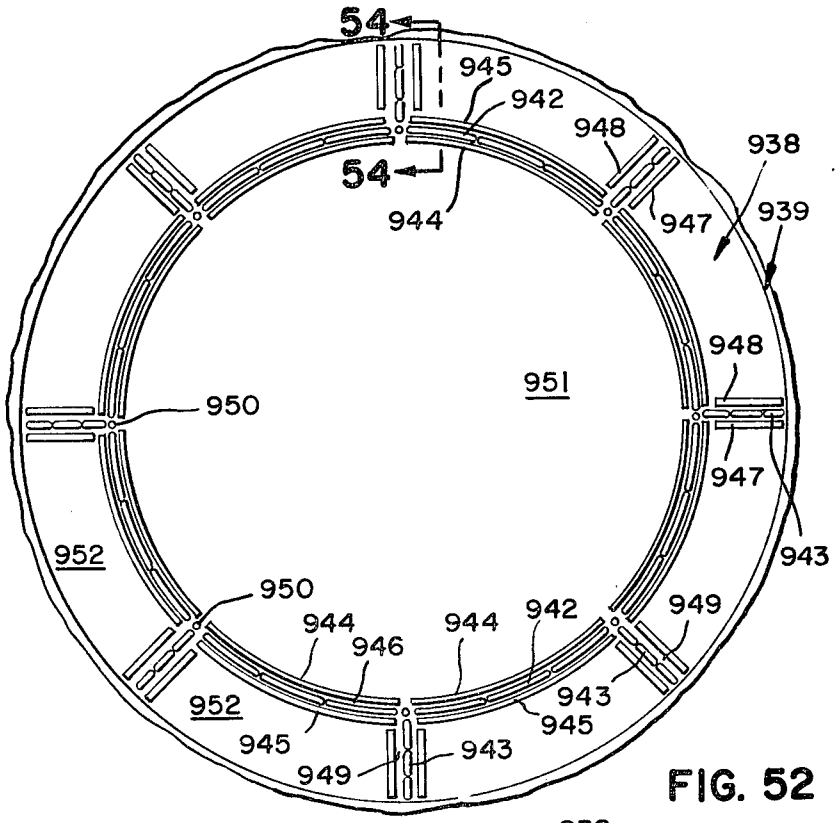
FIG. 52 is a plan view of the cover shown in FIG. 51 positioned in a full reservoir.
Figure 53:
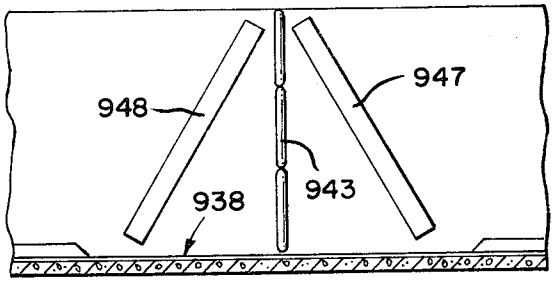
FIG. 53 is a cross section of a portion of the reservoir taken along 53—53 of FIG. 51.

Curved floats 944 and 945 may be spaced from weights 942 to provide protection for workmen walking near sump 946. Floats 947 and 948 may be attached on either side of weights 943 to protect workmen walking near sump 949. As shown in FIG. 53, floats 947 and 948 are attached at an angle to weights 943. As the reservoir fills, the floats become parallel as shown in FIG. 52. Spot weights 950 are attached to the cover so that as the reservoir fills they will insure that the excess cover material will sink and permit interconnection of circular sump 946 at each point of intersection with straight line sumps 949.

Figure 54:
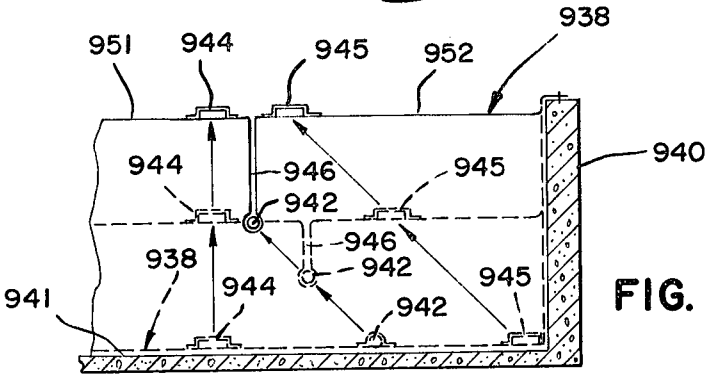
FIG. 54 is a cross section of a portion of the reservoir taken along line 54—54 of FIG. 52. The broken lines show the position of the cover in an empty and partially filled condition.
Figure 51:
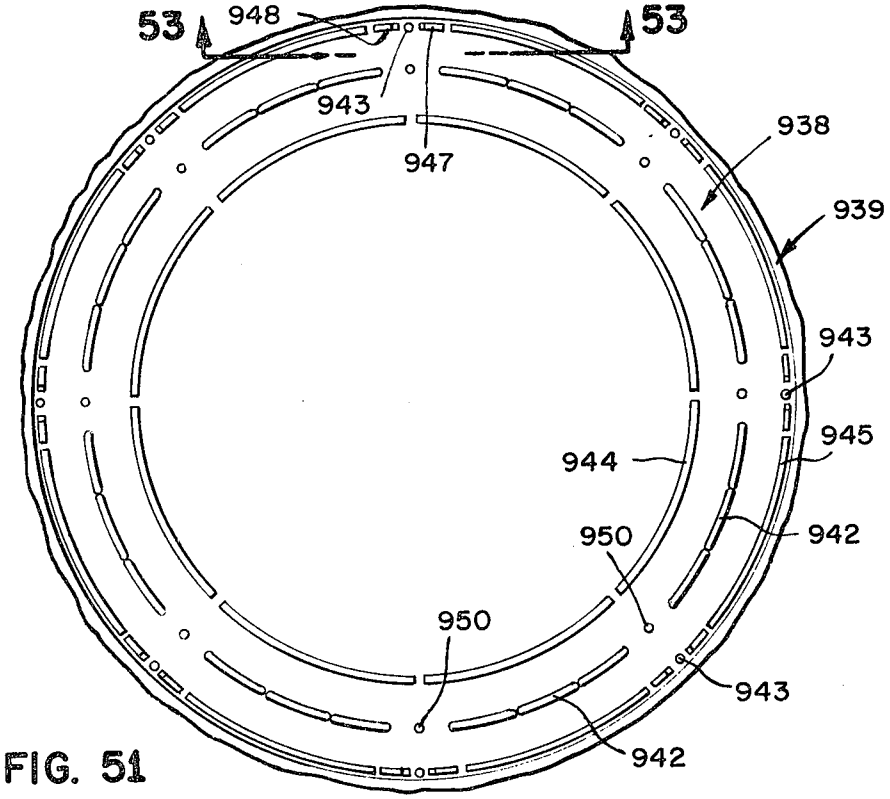
FIG. 51 is a plan view of another form of the cover of the present invention shown positioned in an empty reservoir.

FIG. 54 illustrates the function of weights 942 to form sump 946. When the reservoir is empty, weights 942 are on the bottom of the reservoir and weights 943 hang against the side. As the reservoir fills, all portions of the cover are placed in tension from the lowest fluid elevation to the fullest level. The tensioned cover is formed with a central plate 951 and a plurality of segmented plates 952. In summary, workmen can walk on every part of the reservoir at all fluid levels.

In example 22 as shown in FIGS. 55–58, a tensioned plate reservoir cover 953 is disclosed for placement upon the fluid surface of an open reservoir 955 having substantially vertical sidewalls 956, a substantially horizontal bottom wall 957 and a circular shape. The weighting means, such as segmented weights 958 are annularly spaced and attached to the cover. The weights extend from the periphery and each line of segmented weights has a length such that when the reservoir is full, each of the lines of weights will extend radially inwardly toward the center and the distal end 959 of each line of weights will terminate at a point less than one half of the diameter of the reservoir.

The weight means includes a spot weight 960 connected to the cover at the geometric center of the reservoir.

When the reservoir is empty, the distance between the distal ends of the weights and the geometric center of the reservoir should be substantially equal to the distance between the bottom surface and the maximum height of the working fluid level of the reservoir.

Figure 56:
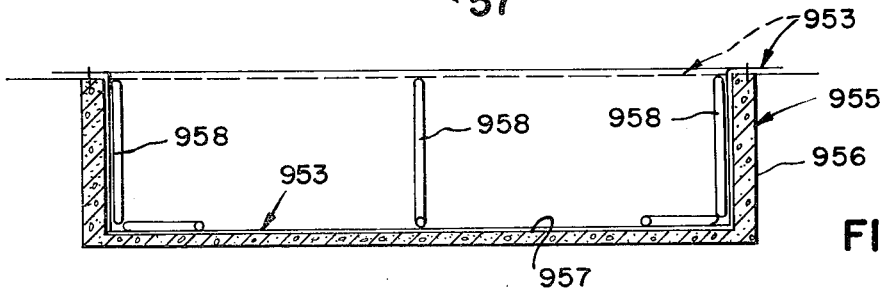
FIG. 56 is a cross section of the reservoir taken along line 56—56 in FIG. 55.
Figure 57:
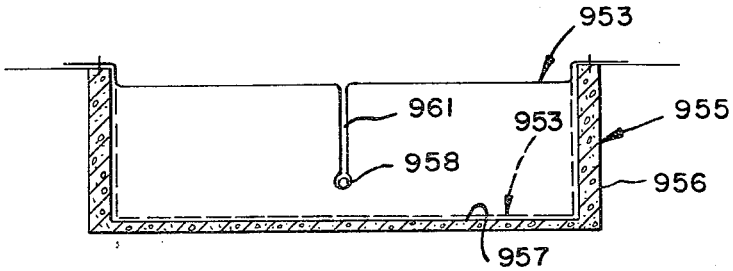
FIG. 57 is a cross section taken along line 57—57 of FIG. 55.
Figure 58:
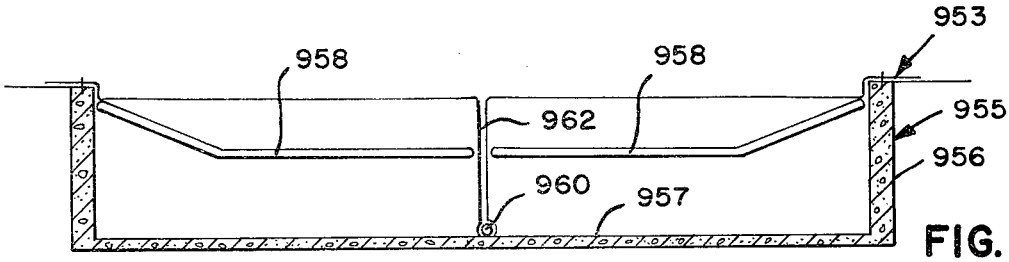
FIG. 58 is a cross section of the reservoir taken along line 58—58 in FIG. 55. The cover is shown in a position taken when the reservoir is full.
Figure 60:
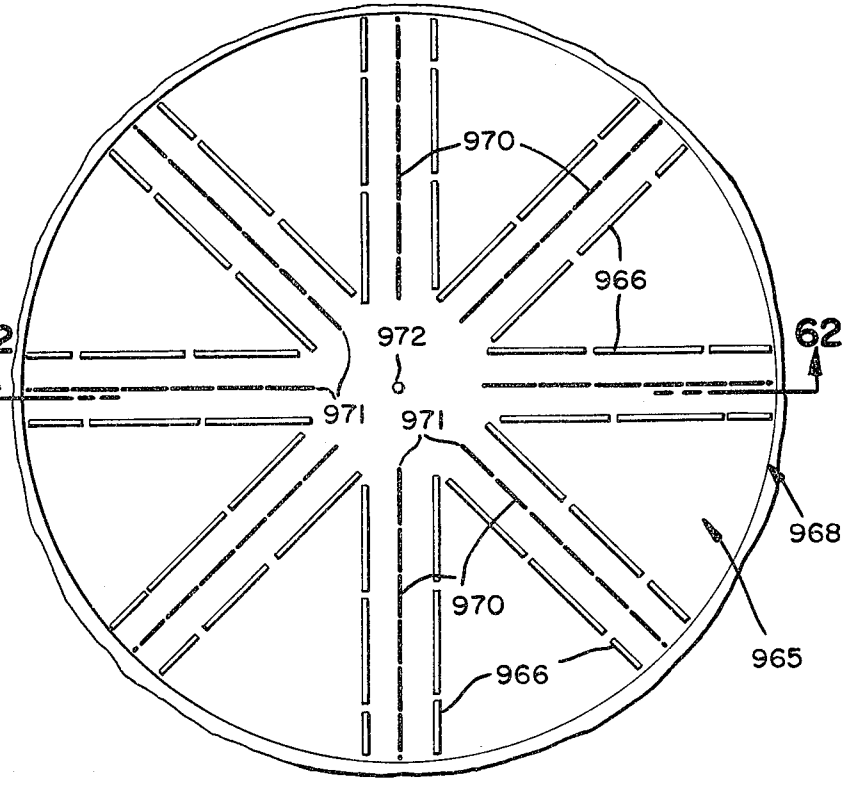
FIG. 60 is a plan view of the reservoir shown in FIG. 59 with the cover positioned in an empty reservoir.
Figure 59:
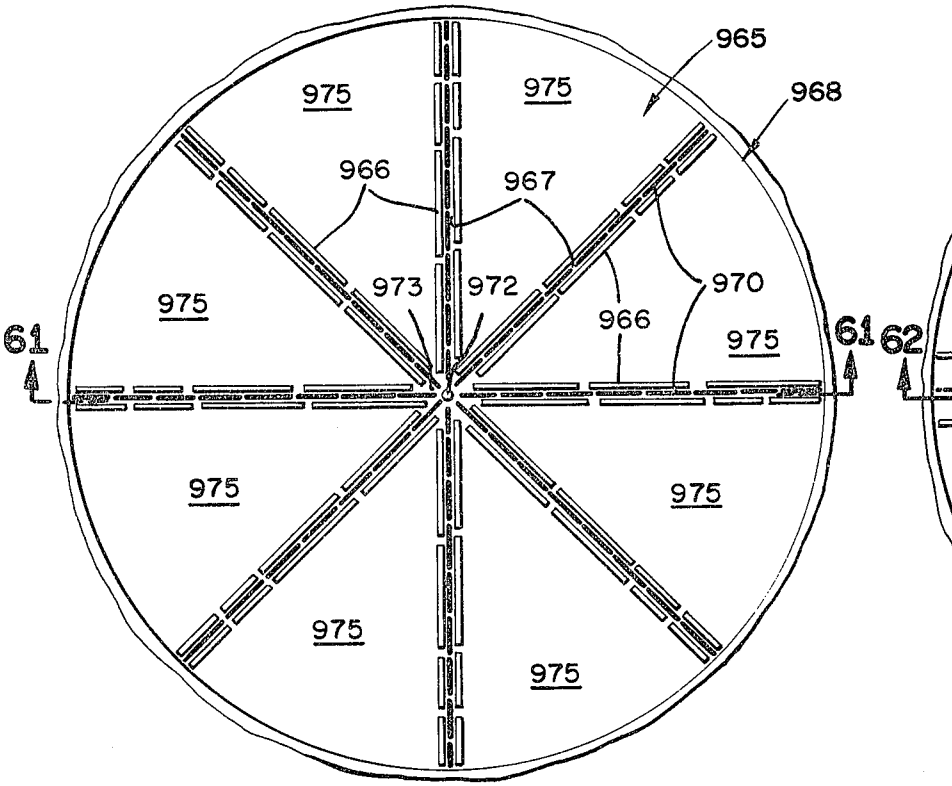
FIG. 59 is a plan view of another form of the invention with the cover positioned in a full reservior.
Figure 62:
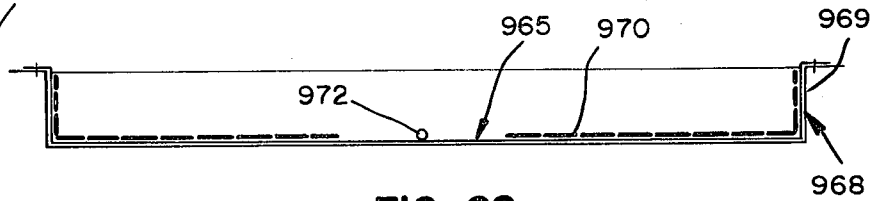
FIG. 62 is a cross section taken along line 62—62 of FIG. 60.
Figure 61:
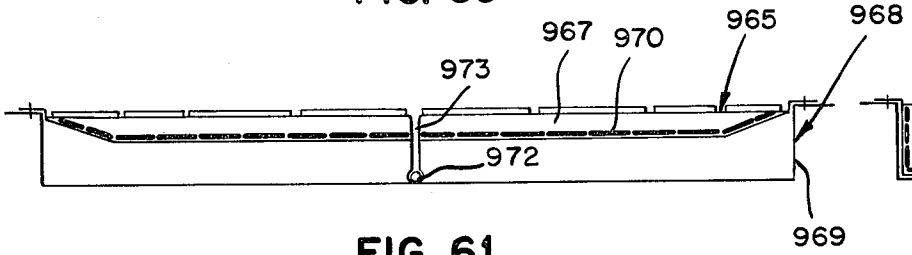
FIG. 61 is a cross section taken along line 61—61 of FIG. 59.

As shown in FIG. 56, the weights 958 initially hang down the side of the reservoir when it is empty and extend radially toward the center. The spot weight 960 is located at the bottom of the reservoir and remains on or close to the bottom at all levels of the fluid in the reservoir.

As the fluid rises in the reservoir, a plurality of sumps 961 are formed above each weight 958. The spot weight 960 forms a center sump 962 which interconnects with all of the radial sumps 961.

Figure 55:
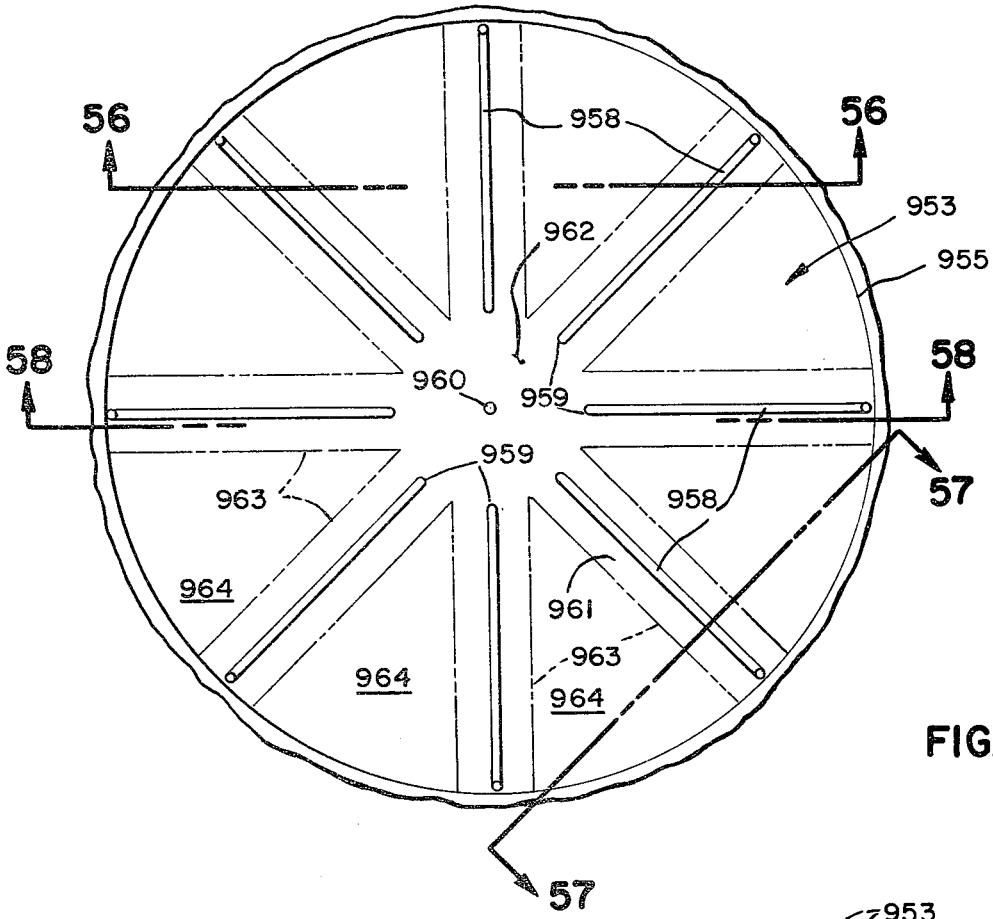
FIG. 55 is a plan view of another form of the invention showing the position of the cover in an empty circular vertical wall reservoir.

In FIG. 55, the broken lines 963 indicate the boundry between the radial sumps 961 and the tensioned plates 964. Thus as the water rises all of the "pie-shaped" areas 964 are in tension and workmen can walk upon these areas.

Example 23 is shown in FIGS. 59–62. Tensioned plate cover 965 is similar to cover 953 in FIGS. 55–58 except that safety floats 966 are attached to the cover at the boundries of each of the radiating sumps 967. It may also be noted that the circular reservoir 968 is formed with a large diameter to vertical sidewall 969 height. Weights 970 are attached to the cover and extend from the periphery radially inwardly and the distal ends 971 terminate short of the center so that when the reservoir is full, they will not touch each other. A spot weight 972 is attached at the center of the cover and remains at or near the bottom of the reservoir at all fill levels creating a center sump 973 which interconnects with radiating sumps 967 formed by weights 970. At all fill levels, the entire cover, including the sumps are in tension so that workmen can walk on tensioned plates 975.

Figure 64:
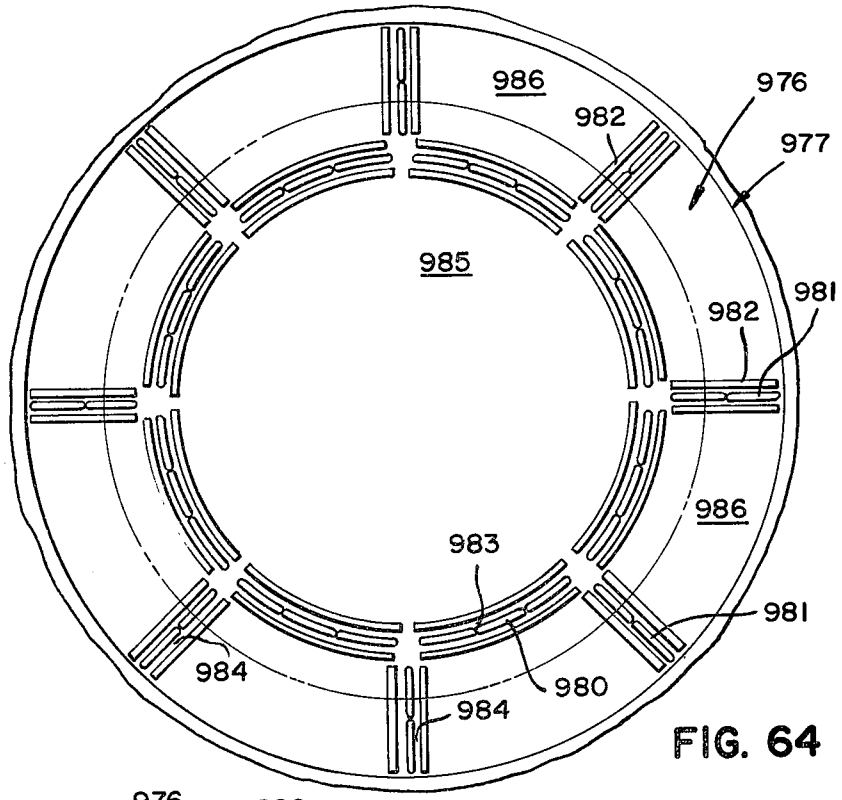
FIG. 64 is a plan view of the reservoir shown in FIG. 63 with the cover shown in a position when the reservoir is full.
Figure 63:
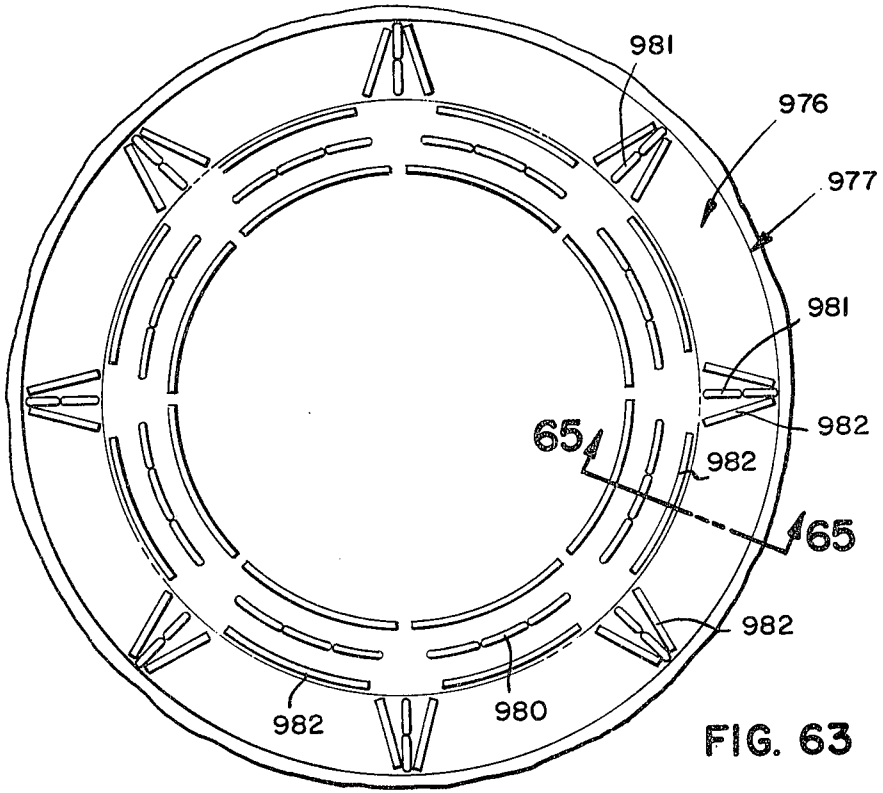
FIG. 63 is a plan view of another form of the invention shown in a circular slant walled reservoir with the cover shown in a position when the reservoir is empty.
Figure 65:
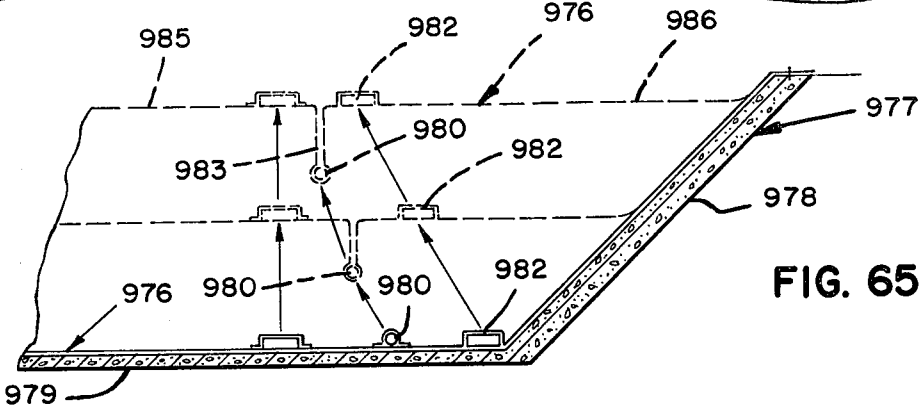
FIG. 65 is a cross section taken along line 65—65 of FIG. 63. The broken lines show the position of the cover when the reservoir is partially empty and full.

Example 24 is shown in FIGS. 63–65. Tensioned cover 976 covers circular reservoir 977 which is formed with sloping sides 978 and a flat bottom 979. The weighting means includes a plurality of weights 980 connected to the cover at a location spaced inwardly from the intersection of the sloping sidewall and bottom walls when the cover rests in the empty reservoir. The weighting means also includes a plurality of annularly spaced weights 981 attached to the cover which extend from the periphery to the intersection of the sloping wall and bottom wall when the reservoir is empty. Safety floats 982 may be attached to the cover so that they are on opposite sides of the circular sump 983 formed by weights 980 and on either side of the side of the radial sump 984 formed by weights 981. FIG. 65 illustrates the positioning of weights 980 and the manner and location of the formation of sump 983. The entire cover is maintained in tension at all levels of the reservoir. Workmen can stand on tensioned plate 985 formed in the center of the reservoir and tensioned plates 986 bounded by sump 983, radial sumps 984 and the peripheral edge of the reservoir.

Figure 67:
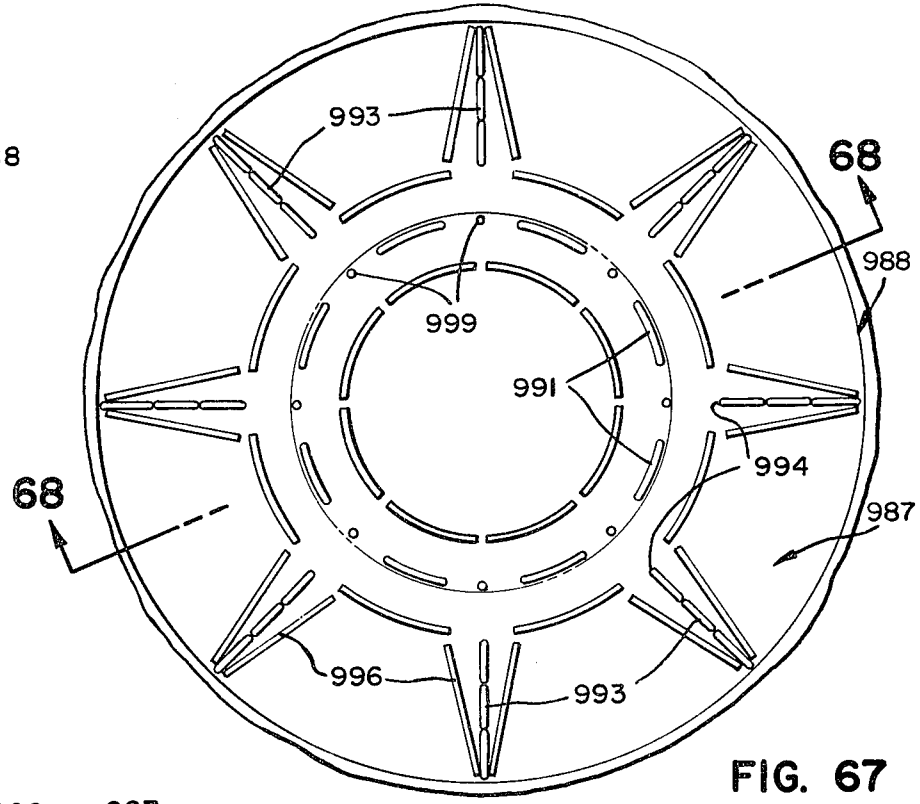
FIG. 67 is a plan view of the cover shown in FIG. 66. The cover is shown in position in an empty reservoir.
Figure 66:
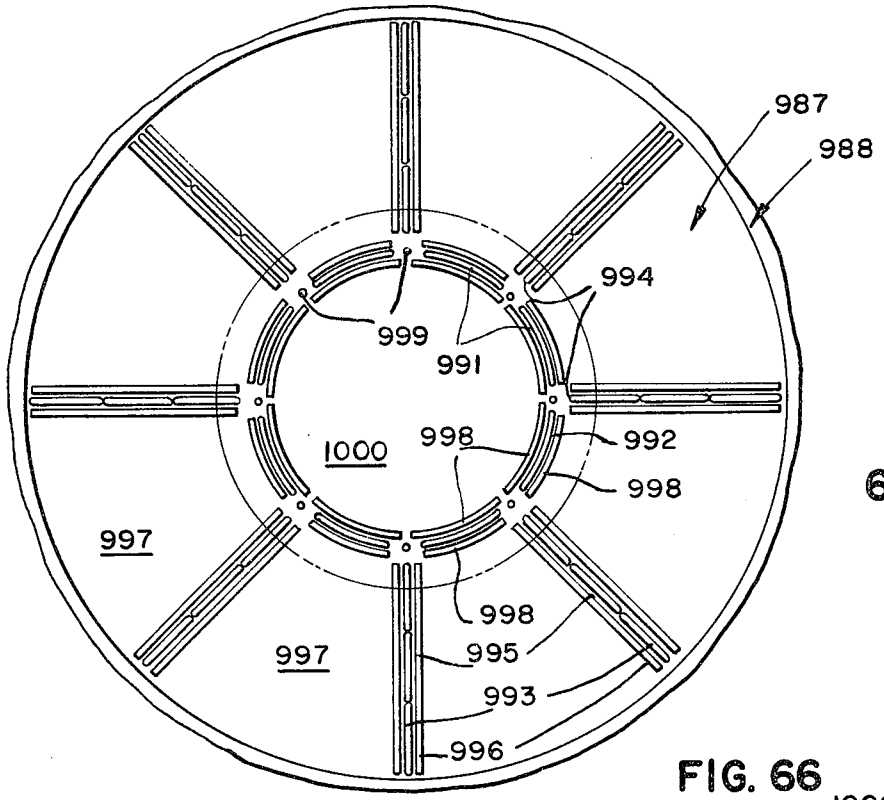
FIG. 66 is a plan view of another form of the invention. The cover is shown in a position taken when the reservoir is full.
Figure 68:
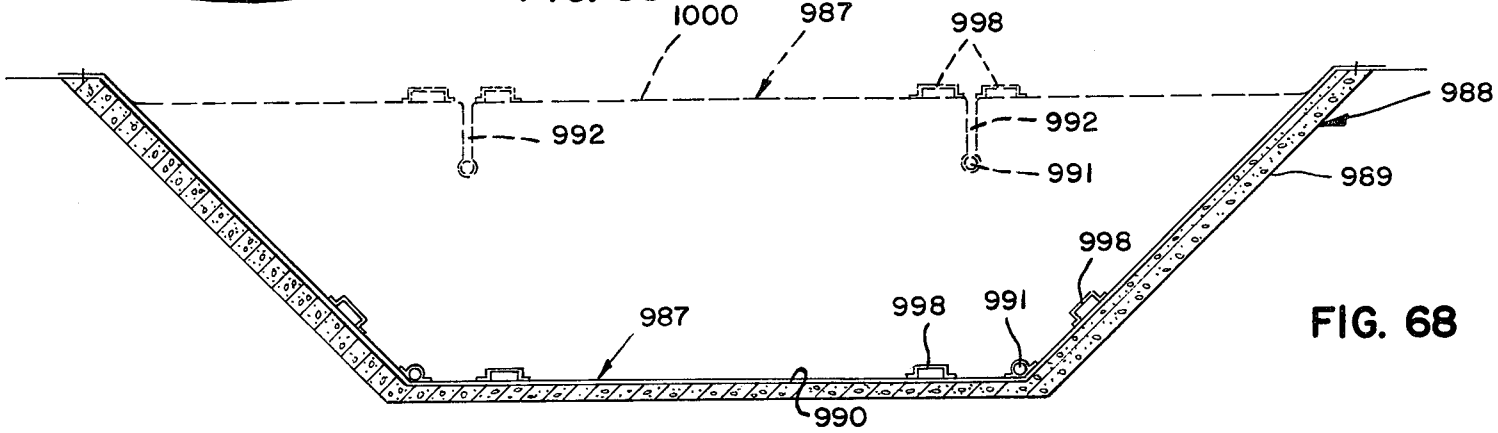
FIG. 68 is a cross section view of the reservoir shown in FIG. 67 and taken along line 68—68. The broken lines show the position of the cover when the reservoir is full.
Figure 70:
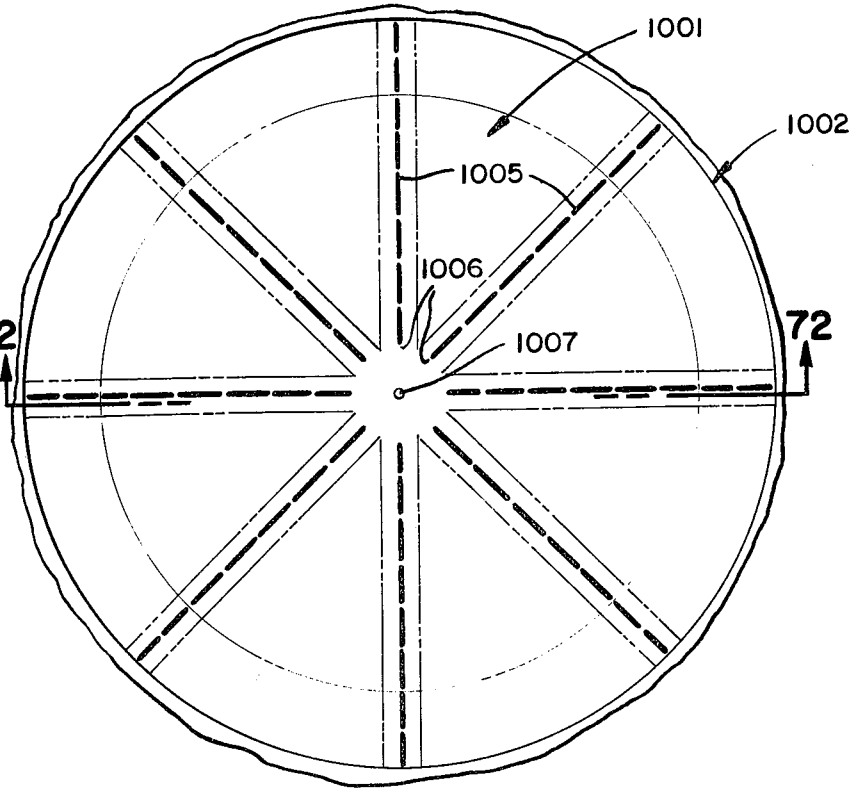
FIG. 70 is a plan view of the cover shown in FIG. 69 with the cover shown in an empty reservoir.
Figure 69:
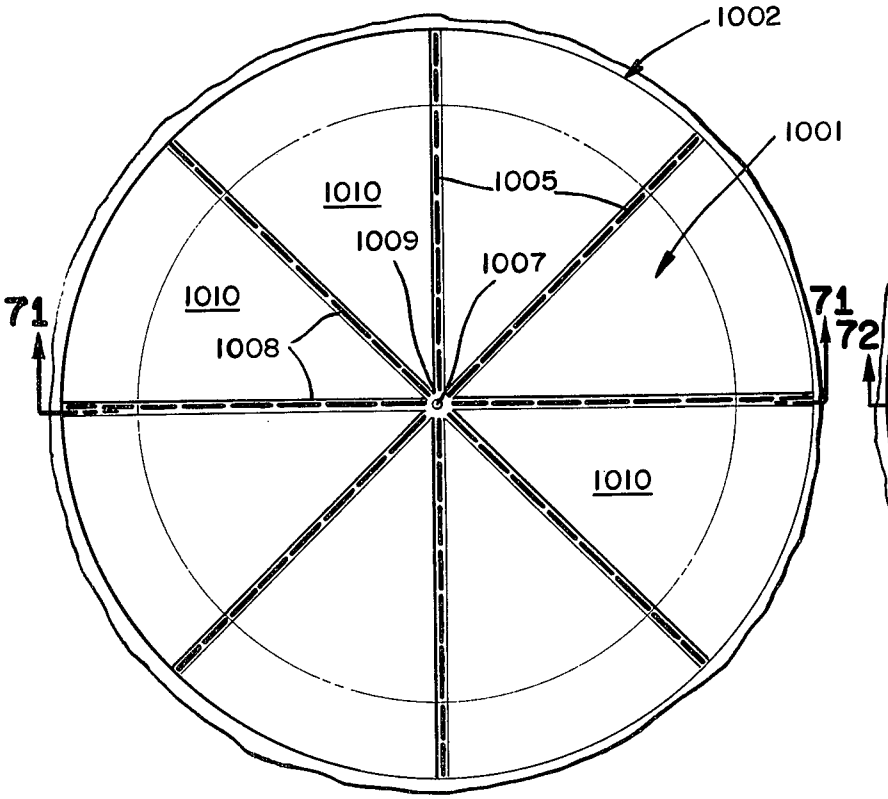
FIG. 69 is a plan view of another form of the invention. The cover is shown in position in a full reservoir.

In example 25 shown in FIGS. 66–68, tensioned cover 987 is constructed for placement upon the fluid surface of an open reservoir 988 having sloping sidewalls 989, a substantially horizontal bottom wall 990 and a curvilinear shape. Segmented weights 991 are connected to the cover at a location adjacent the intersection of the sloping wall and the bottom wall when the cover rests in the empty reservoir. A continuous inner sump 992 is formed by the weights as the reservoir is filled with fluid. A plurality of annularly spaced weights 993 are attached to the cover and extend from the periphery radially toward the center of the reservoir. The weights terminate at a point 994 adjacent the inner sump 992 and form a plurality of sumps 995 radiating from the periphery of the reservoir to the inner sump and connecting therewith.

Safety floats 996 may be attached to the cover on both sides of the sumps 995 to protect workmen walking on the cover. The floats are attached at the boundry of sumps 995 and tensioned plates 997 which are bounded by sumps 995, 992 and the periphery of the reservoir.

Safety floats 998 may be attached to the cover on both sides of inner sump 992.

Preferably spot weights 999 are attached to the cover at the intersection of the inner sump 992 and radial sumps 995 to insure that the radial and inner sumps interconnect.

FIG. 68 illustrates the position of cover 987 in the reservoir when it is empty and the broken lines show the position of the cover when it is full.

The entire cover is in tension immediately upon filling the reservoir and continues in tension upon filling to any level.

The inner sump 992 forms the boundry of central tension plate 1000.

In example 26 as shown in FIGS. 69–72, a tensioned plate reservoir cover 1001 is disclosed for placement upon the fluid surface of an open reservoir 1002 having sloping sidewalls 1003, a substantially horizontal bottom wall 1004 and a circular shape. The weighting means, such as segmented weights 1005 are annularly spaced and attached to the cover. The weights extend from the periphery radially inwardly and each line of segmented weights has a length such that when the reservoir is full each line of weights will extend radially inwardly toward the center and the distal end 1006 of each line of weights will terminate at a point less than one half the diameter of the reservoir.

The weight means includes a spot weight 1007 connected to the cover at the geometric center of the reservoir.

Figure 72:
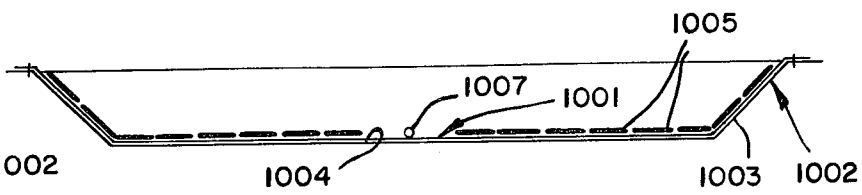
FIG. 72 is a cross section of the reservoir shown in FIG. 70 taken along line 72—72.
Figure 71:
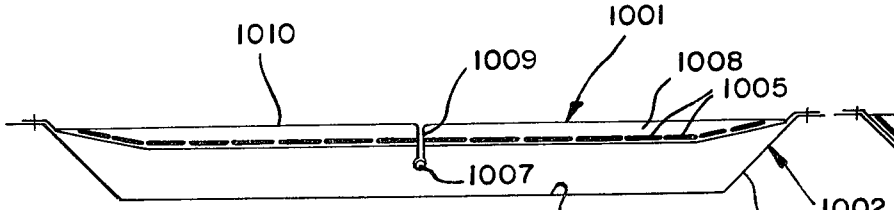
FIG. 71 is a cross section of the cover shown in FIG. 69 and taken along line 71—71.
Figure 74:
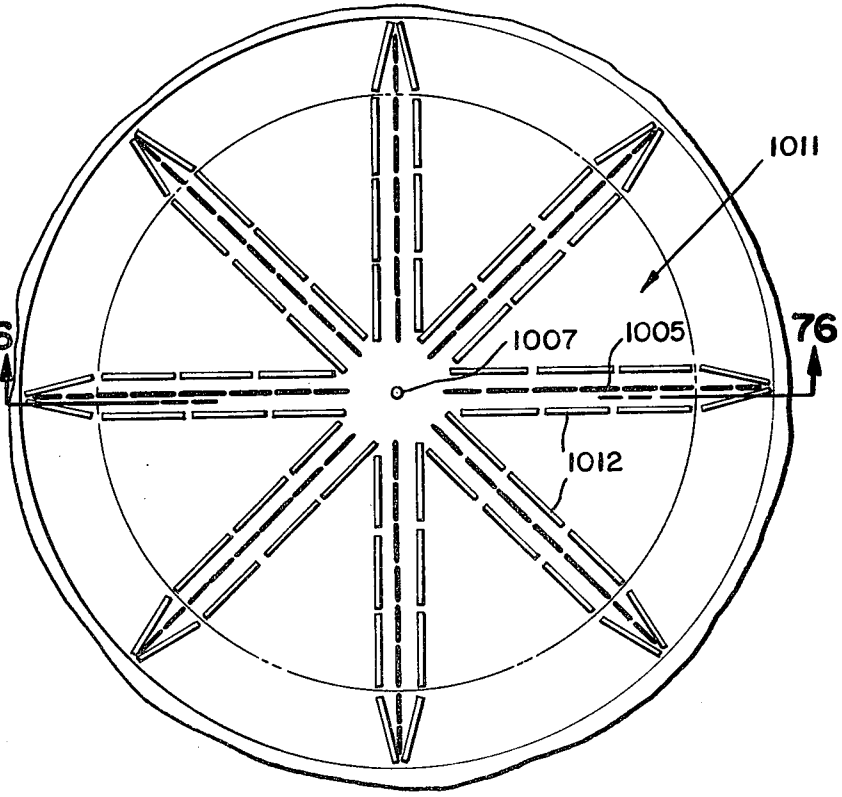
FIG. 74 is a top plan view of the reservoir shown in FIG. 73. The cover is shown in a position when the reservoir is empty.
Figure 73:
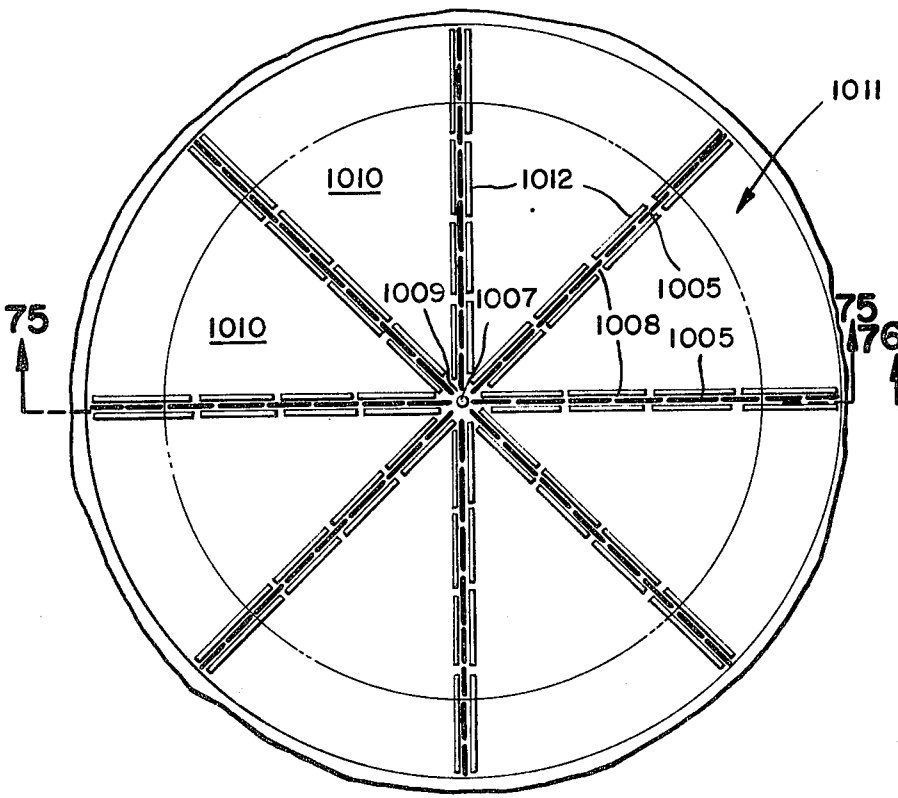
FIG. 73 is a top plan view of another form of the invention with the cover shown in place in a reservoir which is full.
Figure 76:
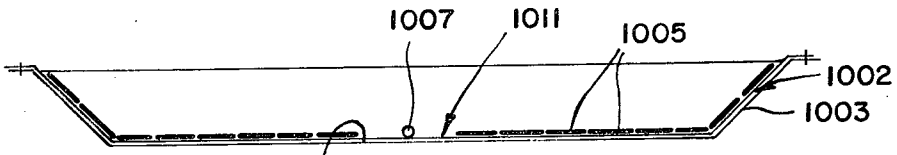
FIG. 76 is a cross section view of the reservoir in FIG. 74 taken along line 76—76.
Figure 75:
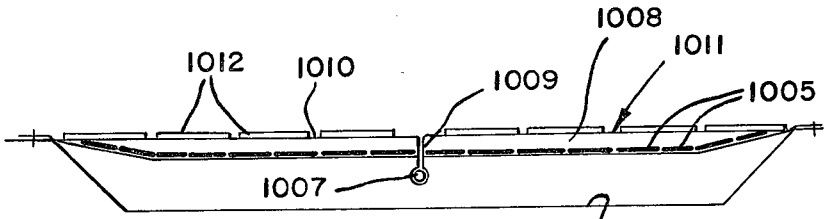
FIG. 75 is a cross section of the reservoir cover shown in FIG. 73 taken along line 75—75.

As shown in FIG. 72 the weights initially rest on the sides and bottom of the reservoir when it is empty and extend radially toward the center. The spot weight 1007 is located at the bottom of the reservoir and moves vertically from the bottom at all levels of the fluid in the reservoir.

As the fluid rises in the reservoir, a plurality of radial sumps 1008 are formed above each weight 1005. The spot weight 1007 forms a center sump 1009 which interconnects with all of the radial sumps 1008.

The wedge shaped portions of the cover between the radial sumps and referred to as tension plates 1010 are formed at all levels of the reservoir and enable workmen to walk upon all areas of the cover for inspection and cleaning.

The reservoir cover 1011 shown in FIGS. 73–76 is identical to cover 1001 of FIGS. 69–72 except that floats 1012 are attached to the cover at the edges of each radial sump. Like parts in the drawings have been given like numbers. The cover functions in the same manner as the cover of example 26 except that there is a greater degree of safety with the provision of the floats.

I claim:

1. A tensioned reservoir cover for placement upon the fluid surface of an open reservoir comprising:

a. a flexible cover member of substantially fluid impervious material of sufficient area to cover the sidewalls and bottom of said reservoir when empty;

b. means connecting the perimeter of said cover member to the perimeter of said reservoir;

c. weighting means positioned with respect to said cover member at pre-selected positions;

d. a plurality of cover sump portions formed in said cover by said weighting means, each of said sump portions being defined, narrow, elongated and interconnected and having generally vertical sidewalls in tension and having a selected location for all working fill levels of said reservoir;

e. a plurality of generally horizontal cover portions formed in said cover by said weighting means, each of said horizontal cover portions having a selected geometric shape and positioned at a selected location for all working fill levels of said reservoir and all of said horizontal cover portions are in tension in at least two different horizontal directions of sufficient magnitude to permit workmen to traverse all portions of said horizontal cover portions for all working fill levels with said horizontal cover remaining substantially planar in sustaining the weight of the workmen; and f. said horizontal cover portions are bordered by said reservoir perimeter and said sump portions and cover substantially all of the surface of said reservoir for all working fluid level conditions.

2. A tensioned reservoir cover as described in claim 1 wherein:

a. said weights are positioned so that said sumps include intersection sumps which are formed to intersect each angle formed by the intersection of non-horizontal reservoir sides; and b. said weights forming said intersection sumps are positioned so that they are located on said cover to extend to substantially the location of the maximum full level at the side of said reservoir.

3. A tensioned reservoir cover as described in claim 1 comprising:

a. a plurality of non-interference cover portions each located at the intersection of two or more of said cover sump portions; and b. said weighting means being spaced one from another so that all working fluid levels in said reservoir said weights at said intersections of said sumps in said non-interference cover portions will not make sufficient contact with each other to place said weights in axial compression and will not substantially stress said cover.

4. A tensioned reservoir cover as described in claim 1 comprising:

a. said weight means is positioned on said cover to form a central sump and a central area; and b. said weighting means is positioned on said cover forming a plurality of lines of segmented weights connecting each corner of said reservoir to said central sump.

5. A tensioned reservoir cover as described in claim 1 for placement upon the fluid surface of an open reservoir having substantially vertical sidewalls, a substantially horizontal bottom surface, and having a curvilinear shape, said cover comprising:

a. said weighting means includes inner sump weights positioned with respect to said cover at a location adjacent the intersection of said vertical wall and said bottom surface when said cover rests in said empty reservoir forming a continuous inner sump;

b. said weighting means also includes a plurality of annularly spaced radial weights attached to said cover extending from a location corresponding to at least the maximum fill level and radially toward the center of said reservoir and terminating at points on said cover a distance less than one half the height of said maximum fill level forming a plurality of radial cover sumps operatively connected to said inner sump;

c. said annularly spaced radial weights extend down said vertical wall when said reservoir is empty; and d. said weighting means causing substantially said entire cover to be placed in tension forming a central cover portion in tension bounded by said inner sump weights and forming a plurality of peripheral cover portions in tension bounded by said annularly spaced radial weights and said reservoir periphery as fluid is added or withdrawn beneath the cover at all working fill levels.

6. A tensioned reservoir cover as described in claim 1 for placement upon the fluid surface of an open reservoir having substantially vertical sidewalls, a substantially horizontal bottom surface and having a curvilinear shape, said cover comprising:

a. said weighting means includes inner sump weights connected to said cover at a location spaced inwardly from the intersection of said vertical and bottom walls when said cover rests in said empty reservoir forming a segmented ring;

b. said weighting means also includes a plurality of annularly spaced radial weights attached to said cover extending from a location corresponding to at least the maximum fill level and to said intersection of said vertical wall and bottom surface when said reservoir is empty; and c. said weighting means causing substantially said entire cover to be placed in tension forming a central tension cover portion bounded by inner sump weights and a plurality of peripheral cover portions bounded by said annularly spaced radial weights and said reservoir periphery.

7. A tensioned reservoir cover as described in claim 1 for placement upon the fluid surface of an open reservoir having substantially vertical sidewalls, a substantially horizontal bottom wall and having a circular shape, said cover comprising:

a. said weighting means includes a plurality of annularly spaced radial weights positioned with respect to said cover extending from said periphery and each having a length such that when said reservoir is full, each of said weights will extend radially inward toward the center forming a plurality of radial sumps and the distal end of said weights will terminate at a point less than one half the diameter of said reservoir; and b. said weighting means causing substantially said entire cover to be placed in tension forming a plurality of cover portions bounded by said annularly spaced radial sumps and the periphery of said reservoir as fluid is added or withdrawn beneath the cover at all levels.

8. A tensioned reservoir cover as described in claim 1 for placement upon the fluid surface of an open reservoir having sloping sidewalls, a substantially horizontal bottom surface and having a curvilinear shape, said cover comprising:

a. said weighting means including a plurality of inner sump weights connected to said cover at a location spaced inwardly from the intersection of said sloping sidewall and bottom walls when said cover rests in said empty reservoir forming segments of a ring;

b. said weighting means also includes a plurality of annularly spaced radial weights attached to said cover extending from said periphery to said intersection of said sloping wall and bottom wall when said reservoir is empty; and c. said weighting means causing substantially said entire cover to be placed in tension forming a central tension portion bounded by said inner sump weights and a plurality of peripheral portions bounded by said annularly spaced radial weights and said reservoir periphery as fluid is added or withdrawn beneath the cover at all levels.

9. A tensioned reservoir cover as described in claim 1 for placement upon the fluid surface of an open reservoir having sloping sidewalls, a substantially horizontal bottom surface and having a curvilinear shape, said cover comprising:

a. said weighting means includes inner sump weights connected to said cover at a location adjacent the intersection of said sloping wall and said bottom wall when said cover rests in said empty reservoir forming a continuous inner sump;

b. said weighting means also includes a plurality of annularly spaced radial weights attached to said cover extending from a location corresponding to at least the maximum fill level and radially toward the center of said reservoir and terminating adjacent said inner sump and forming a plurality of sumps radiating from said periphery of said reservoir to said inner sump and connecting therewith; and c. said weighting means causing substantially said entire cover to be placed in tension forming a central tension cover portion in tension bounded by said inner sump weights and a plurality of peripheral cover portions in tension bounded by said annularly spaced radial weights, said inner sump weights and said reservoir periphery as fluid is added or withdrawn beneath the cover at all working fill levels.

10. A tension reservoir cover as described in claim 1 for placement upon the fluid surface of an open reservoir having sloping sidewalls, a substantially horizontal bottom surface and having a circular shape, said cover comprising:

a. said weighting means includes a plurality of annularly spaced radial weights attached to said cover extending from said periphery and each having a length such that when said reservoir is full, each of said weights will extend radially inward toward the center forming a plurality of radial, sumps and the distal end of said weights will terminate at a point less than one half the diameter of said reservoir; and b. said weighting means causing substantially said entire cover to be placed in tension forming a plurality of portions bounded by said annularly spaced radial sumps and the periphery of said reservoir.

11. A tensioned reservoir cover as described in claim 1 having at least one substantially vertical side wall and at least two non-adjacent sloped sides comprising:

a. said weighting means creating at least two defined sumps crossing or coincident with substantially all section lines extending across said vertical side wall and a non-adjacent side of said reservoir; and b. said weighting means creating at least one defined sump crossing or coincident with substantially all section lines extending across non-adjacent sloped sides of said reservoir.

12. A tensioned reservoir cover as described in claim 1 having sloped side walls adjacent the entire perimeter comprising:

a. said weighting means creating at least one defined sump crossing or coincident with substantially all section lines extending across non-adjacent sides of said reservoir.

* * * * *

UNITED STATES PATENT AND TRADEMARK OFFICE

CERTIFICATE OF CORRECTION

PATENT NO. : 4,476,992

DATED : October 16, 1984

INVENTOR(S) : Dennis H. Gerber

It is certified that error appears in the above-identified patent and that said Letters Patent are hereby corrected as shown below:

In Column 1, lines 58 and 59, after "tension", delete "horizontal cover portions sometimes referred to as"

In Column 1, line 59, after "tensioned" insert --- horizontal cover portions sometimes referred to as ---

In Column 3, line 21, after "is" insert --- a ---

In Column 3, line 45, after "FIG. 29" insert --- taken ---

In Column 3, line 62, after "with a" delete "shope" and insert --- slope ---

In Column 4, line 39, after "shown" insert --- in ---

In Column 5, line 62, after "member A of" delete "fuid" and insert --- fluid ---

In Column 8, line 33, after "The" delete "central" and insert --- central ---

In Column 9, line 67, before "more" insert --- or ---

In Column 9, line 67, after "more" delete "more"

In Column 11, line 22, after "non-adjacent" delete "side" and insert --- sides ---

In Column 11, line 51, after "tensioned" delete "plates and insert --- plate ---

In Column 12, line 8, after "arrow" delete "63" and insert --- 363 ---

In Column 12, line 19, after "at the" delete "non-inference" and insert --- non-interference ---

UNITED STATES PATENT AND TRADEMARK OFFICE

CERTIFICATE OF CORRECTION

PATENT NO. : 4,476,992

DATED : October 16, 1984

INVENTOR(S) : Dennis H. Gerber

It is certified that error appears in the above-identified patent and that said Letters Patent are hereby corrected as shown below:

In Column 13, line 67, after "segmented" delete "weight" and insert --- weights ---

In Column 15, line 56, after "718-724" delete ";" and insert --- . ---

In Column 16, line 21, after "extend" delete "form" and insert --- from ---

In Column 16, line 54, after "section" delete "lines" and insert --- line ---

In Column 16, line 60, after "five" delete "sides" and insert --- sided ---

In Column 22, line 15, after "that" insert --- at ---

Signed and Sealed this

*Twenty-fourth* Day of *September 1985*

[SEAL]

*Attest:*

*Attesting Officer*

DONALD J. QUIGG

*Commissioner of Patents and Trademarks—Designate*